US009738352B1

(12) United States Patent
Zook et al.

(10) Patent No.: US 9,738,352 B1
(45) Date of Patent: Aug. 22, 2017

(54) RIFLE FLOTATION DEVICE

(71) Applicant: Green Dragon Ventures, Carlsbad, CA (US)

(72) Inventors: Kristian Dawn Zook, Carlsbad, CA (US); David Phillip Ondash, Carlsbad, CA (US)

(73) Assignee: GREEN DRAGON VENTURES, Carlsbad, CA (US)

( * ) Notice: Subject to any disclaimer, the term of this patent is extended or adjusted under 35 U.S.C. 154(b) by 0 days.

(21) Appl. No.: 15/384,274

(22) Filed: Dec. 19, 2016

Related U.S. Application Data

(63) Continuation-in-part of application No. 29/587,874, filed on Dec. 15, 2016.

(51) Int. Cl.
*F41C 27/00* (2006.01)
*B63B 22/00* (2006.01)

(52) U.S. Cl.
CPC ..... *B63B 22/00* (2013.01); *F41C 27/00* (2013.01)

(58) Field of Classification Search
CPC ..... F41C 27/00; F41C 23/12; F41C 23/16; F41C 23/22; F41A 35/00; F41A 99/00; B63B 22/00
USPC ..... 42/90, 124, 96, 106, 72
See application file for complete search history.

(56) References Cited

U.S. PATENT DOCUMENTS 2,364,340 A * 12/1944 Bogg, Jr. ..... F41A 35/02 42/106
6,782,652 B1 * 8/2004 Erickson ..... F41A 35/02 42/124
7,243,454 B1 * 7/2007 Cahill ..... F41C 23/12 42/72
7,562,483 B2 * 7/2009 Hines ..... F41G 11/003 42/71.01
7,856,749 B2 * 12/2010 Fitzpatrick ..... F41C 23/16 42/85
9,523,551 B2 * 12/2016 Iannello ..... F41G 11/003
9,650,112 B1 * 5/2017 Milam ..... B63B 22/08
2003/0106252 A1 * 6/2003 Hines ..... F41A 35/02 42/90
2004/0064994 A1 * 4/2004 Luke ..... F41C 23/16 42/85
2005/0188588 A1 * 9/2005 Keng ..... F41C 23/16 42/72
2006/0075672 A1 * 4/2006 Romer ..... F41G 11/003 42/10
2008/0052978 A1 * 3/2008 Cahill ..... F41C 23/12 42/90
2009/0241397 A1 * 10/2009 Fitzpatrick ..... F41C 23/16 42/90

(Continued)

*Primary Examiner* — Jonathan C Weber
(74) *Attorney, Agent, or Firm* — Manuel de la Cerra

(57) ABSTRACT

A rifle flotation device for providing buoyancy to a rifle with a rifle rail system is disclosed. The device includes a buoyant body with a first and second keyed rifle rail slots constructed to allow the rifle rail system to be inserted therein. The buoyant body may further include a first buoyant body portion that includes the first keyed rifle rail slot and a second buoyant body portion that includes the second keyed rifle rail slot. The first buoyant body portion is detachable from the second buoyant body portion and the body may further include an interlocking tongue-in-groove system that attaches the first buoyant body portion to the second buoyant body portion.

19 Claims, 24 Drawing Sheets

(56) References Cited

U.S. PATENT DOCUMENTS

| | | | | |
|---|---|---|---|---|
| 2010/0236124 | A1* | 9/2010 | Troy | F41A 35/02<br>42/90 |
| 2011/0076095 | A1* | 3/2011 | Storch | F41C 27/00<br>403/322.4 |
| 2012/0055061 | A1* | 3/2012 | Hartley | F41C 23/16<br>42/84 |
| 2012/0085013 | A1* | 4/2012 | Cahill | F41A 35/02<br>42/96 |
| 2014/0196348 | A1* | 7/2014 | Samson | F41C 27/00<br>42/90 |
| 2014/0360079 | A1* | 12/2014 | Iannello | F41C 23/16<br>42/90 |
| 2015/0300775 | A1* | 10/2015 | Combs | F41C 23/16<br>42/72 |

* cited by examiner

RIFLE FLOTATION DEVICE

RELATED APPLICATIONS

This application claims priority to U.S. Provisional Patent Application No. 62/430,914 filed on Dec. 6, 2016, titled "FLOTATION DEVICE FOR RIFLE"; and priority as a continuation-in-part to U.S. Design patent application No. 29/587,874 filed on Dec. 15, 2016, titled "RIFLE FLOTATION DEVICE", the disclosures of both of which are herein incorporated by reference in their entirety.

TECHNICAL FIELD

The present invention relates to devices that can be used with firearms, and more specifically relates to devices that can be attached to firearms to provide buoyancy.

BACKGROUND

For military personnel engaged in combat, being able to fire your weapon can mean the difference between life and death. But when personnel are in or around water, the weapon can be dead weight that creates a hazard. For example, where a military team is compromised exiting or entering the water while engaged in a fire fight, the weapon can be heavy and requires the personnel to swim and simultaneously hold the weight of the weapon and shoot. Personnel not engaged in direct combat, still need to both maintain buoyancy and swim/float and maintain security in order to complete the mission. For example, for those that are in some type of water craft, a weapon that is dropped overboard would sink and compromise the mission.

To address these concerns, life jackets have been taped to the weapon in a makeshift fashion to provide buoyancy. Alternatively, the weapons have been tethered to the watercraft to prevent them from being inadvertently dropped overboard.

However, these previous efforts have several shortcomings in that they either require an adhesive (such as tape) to secure the float to the weapon (but adhesive is often comprised or ineffective in a moist environment), or they require complicated fasteners that can be difficult to fasten in the heat of a military campaign. Furthermore, these previous efforts are large and bulky, making them difficult to store in the personnel's backpacks.

Therefore, a need exists for device that quickly connects to a rifle to provide buoyancy, which also breaks down into a size and shape that is more easily stored.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The apparatus, systems, and methods described herein elegantly solve the problems presented above. A rifle flotation device for providing buoyancy to a rifle with a rifle rail system is disclosed. The device includes a buoyant body with a first and second keyed rifle rail slots constructed to allow the rifle rail system to be inserted therein. The buoyant body may further include a first buoyant body portion that includes the first keyed rifle rail slot and a second buoyant body portion that includes the second keyed rifle rail slot. The first buoyant body portion is detachable from the second buoyant body portion, and the body may further include an interlocking tongue-in-groove system that attaches the first buoyant body portion to the second buoyant body portion. The tongue-in-groove system may be tapered.

The device may also have a third keyed rifle rail slot constructed to allow the rifle rail system to be inserted therein, and the third slot may be formed at the union of the first and second buoyant body portions. The device may have a rifle slot or a rifle hand grip slot. The rifle may also have a hand grip that includes finger divots.

To lock the device to the rifle, a rifle rail lock and release mechanism may be used. The mechanism may include one or more rail engagement pins that can move between an engaged position and a disengaged position, wherein when the pin is in the engaged position, the body is locked to the rifle and when the pin is in the disengaged position, the body can be detached from the rifle. This mechanism can be used on either or both buoyant body portions. The mechanism can include a spring that biases the rail engagement pin in the engaged position. A pull tab, pull button, or push button may be used to change the rail engagement pin from the engaged to disengaged position.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

DETAILED DESCRIPTION

Figure 1:
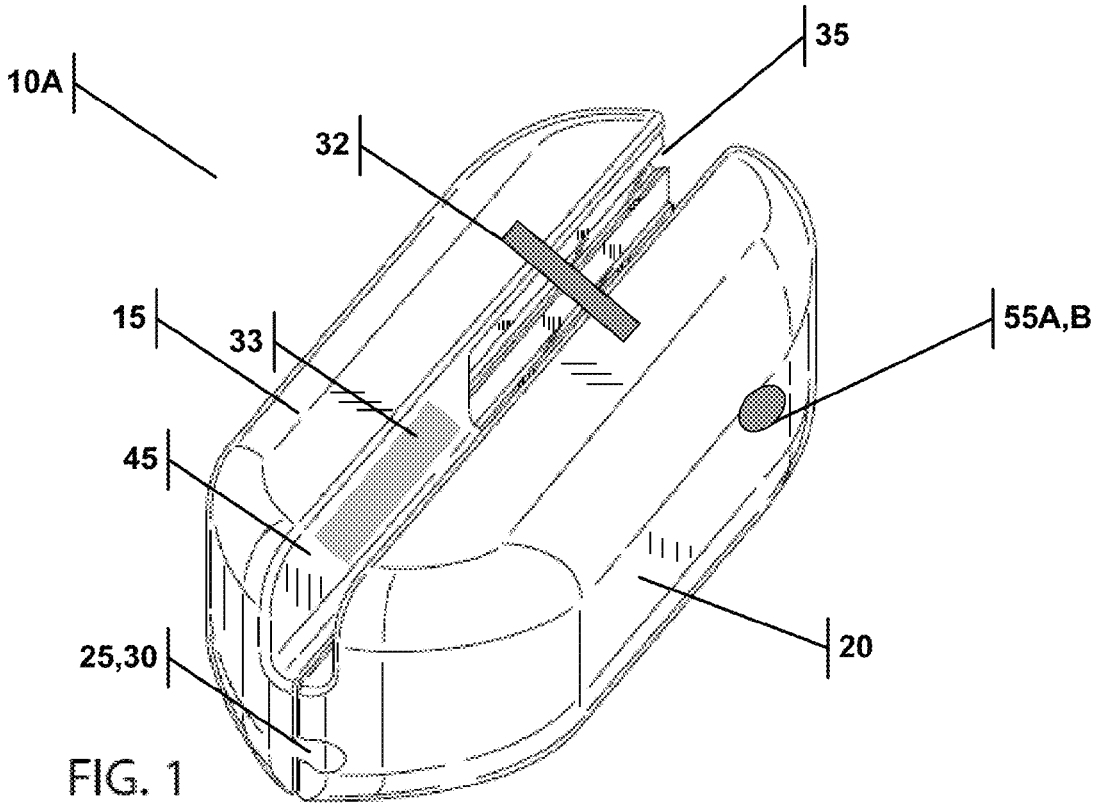
FIG. 1 is a top front perspective view of a first embodiment of a rifle flotation device.
Figure 2:
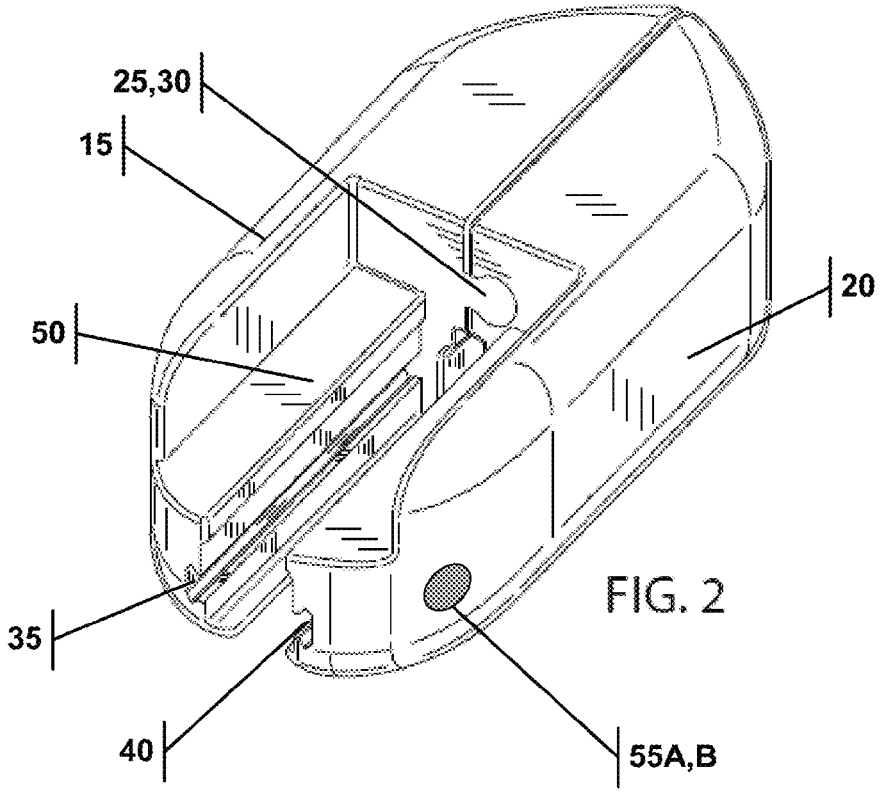
FIG. 2 is a bottom rear perspective view of the first embodiment.
Figure 3:
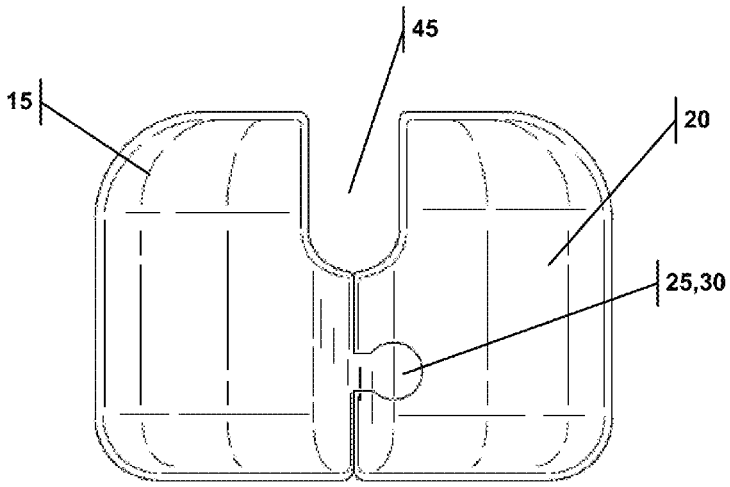
FIG. 3 is a front view of the first embodiment.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1-42 and is provided for ease of reference, where like reference numerals designate corresponding features throughout the specification and figures:

First Embodiment of Rifle Flotation Device 10A
Second Embodiment of Rifle Flotation Device 10B
Third Embodiment of Rifle Flotation Device 10C
First Buoyant Body Portion 15
Second Buoyant Body Portion 20
Tapered Portion-to-Portion Interlocking Tongue 25
Initial Tongue Depth 26
Terminal Tongue Depth 28
Tapered Portion-to-Portion Interlocking Groove 30
Fastener 32
Gripping non-slip material 33
First Keyed Rifle Rail Slot 35
Direction Arrow 36
Second Keyed Rifle Rail Slot 40
Rifle Barrel Slot 45
Rifle Hand Grip Slot 50
First Embodiment of a Rifle Rail Lock and Release Mechanism 55A
Second Embodiment of a Rifle Rail Lock and Release Mechanism 55B
Hand Grip 56
Figure Divots 56A
Third Keyed Rifle Rail Slot 57
Extended Tapered Portion-to-Portion interlocking Tongue 58
Extended Tapered Portion-to-Portion interlocking Groove 59
Rifle Rail Lock and Release Mechanism 55A,B
Pull Tab/Button 60
Rifle 61
Rifle Hand Grip 62
Buoyant Body Portion Surface 64
Flexible Cable 65
Connecting Rod 70
Rail Engagement Pin 75
Spring 80
Retaining Structure 82
Rifle Rail System 85
Rail Bump 86
Pull Tab Release Direction 87
Push Button 90
Flotation Device Surface Recess 95
Connecting Rod with Gearing Teeth 100
Gear 105

Rail Engagement Pin with Gearing Teeth 110
Push Button Release Direction 115
Pivot Arm 120
Pivot 125
Rail Engagement Pin Tip 130
Engagement Slide Direction 135
Rail Engagement Pin Movement 140
Rail Engagement Pin Tip Jumps 145

Now turning to FIGS. 1-16, a first embodiment 10A of a rifle flotation device is shown. The device 10A has a buoyant body that is intended to be mounted to a rifle with a rifle rail system and includes at least two portions 15 and 20. The first buoyant body portion 15 also includes a first keyed rifle rail slot 35 which allows the rifle rail system to be inserted therein. The second buoyant body portion 20 has a second keyed rifle rail slot 40 that also accommodates the rifle rail system. This unique two piece design allows a user to break down and store the device in his backpack.

Figure 4A:
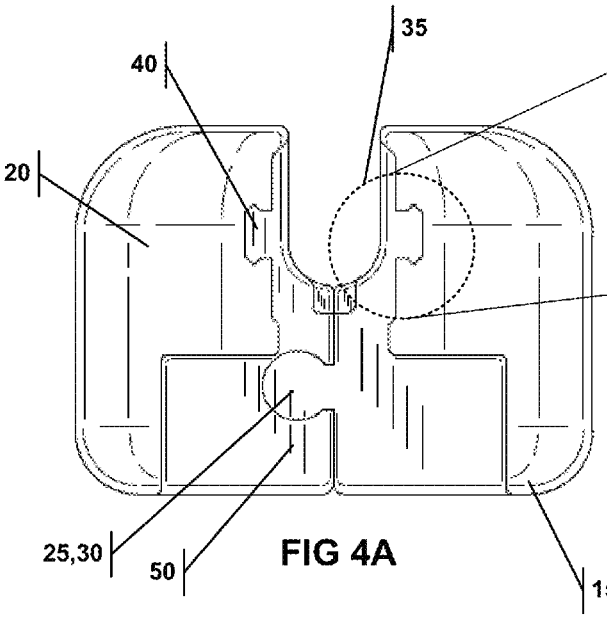
FIG. 4A is rear view of the first embodiment.
Figure 4B:
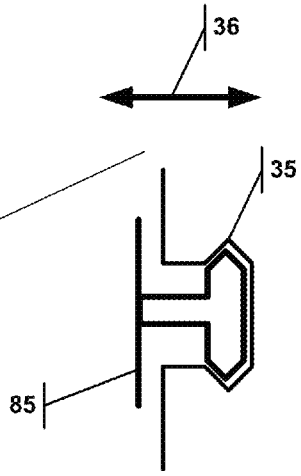
FIG. 4B is a depiction of the keyed rifle slot and the rifle rail system inserted therein.
Figure 5:
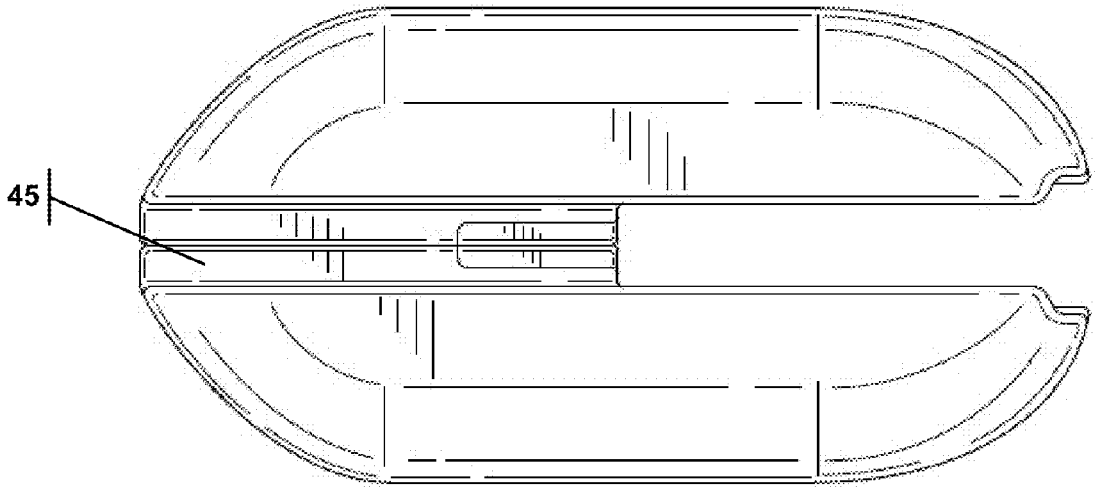
FIG. 5 is a top view of the first embodiment.
Figure 6:
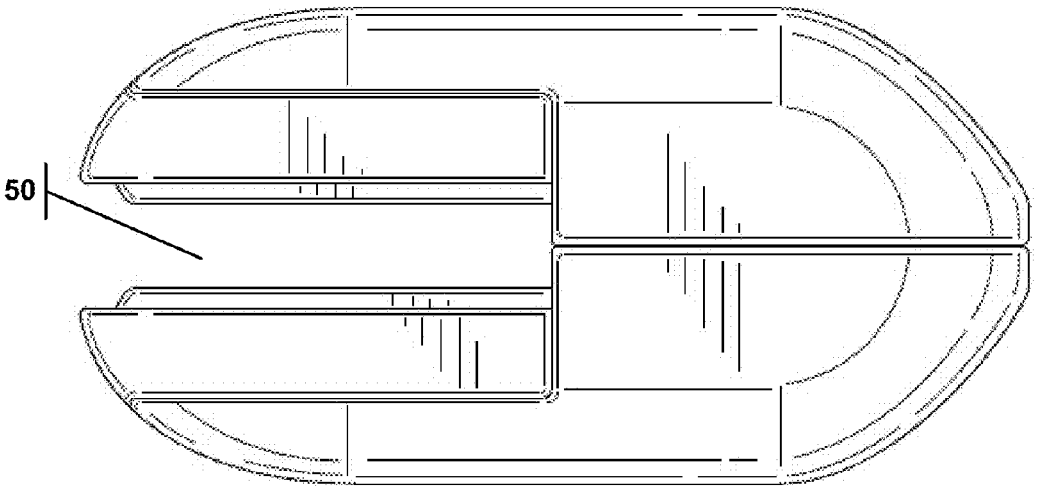
FIG. 6 is a bottom view of the first embodiment.
Figure 7:
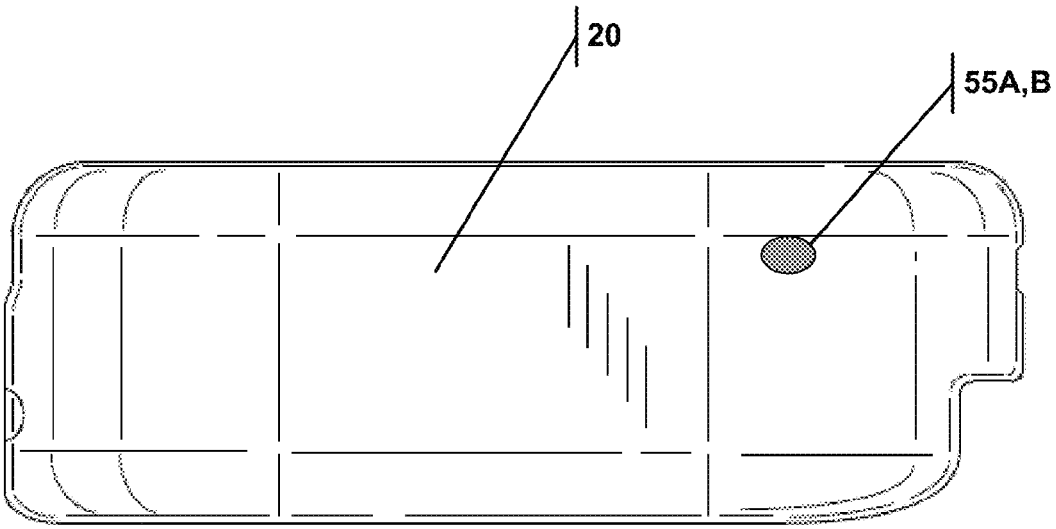
FIG. 7 is a right-side view of the first embodiment.
Figure 8:
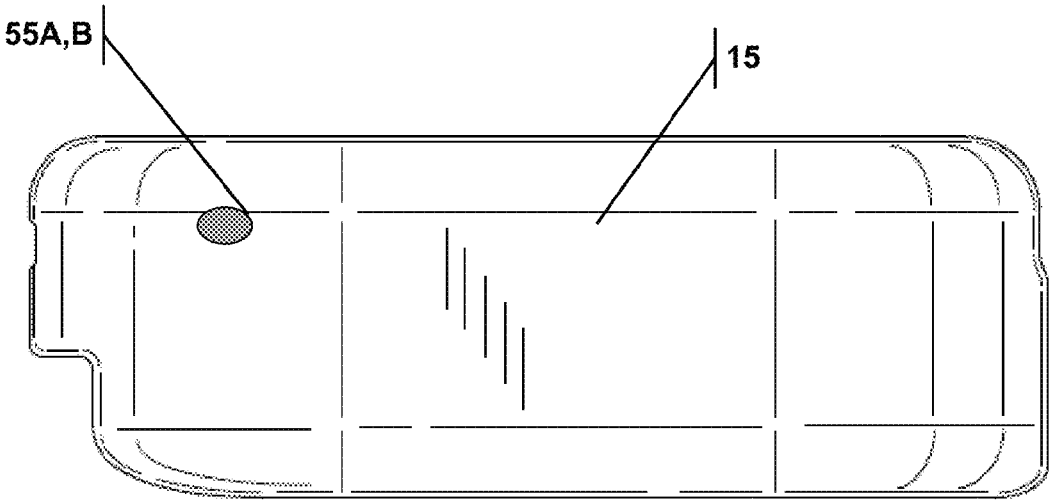
FIG. 8 is a left-side view of the first embodiment.
Figure 9:
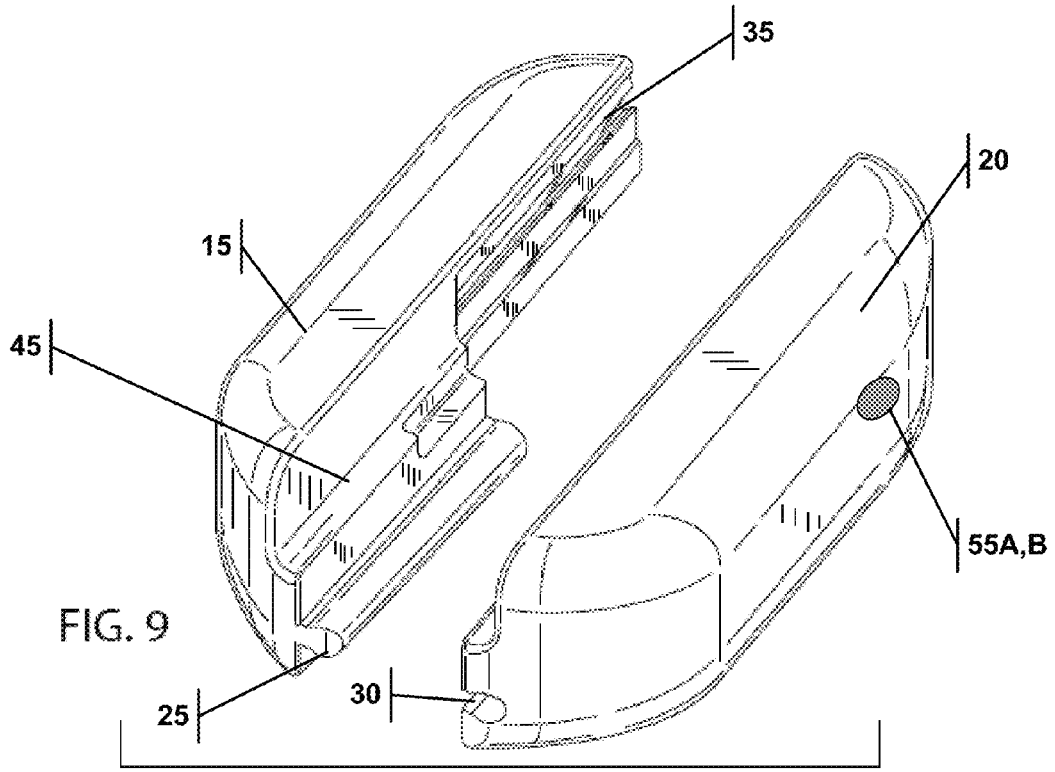
FIG. 9 is a top front perspective exploded view of the first embodiment.
Figure 10:
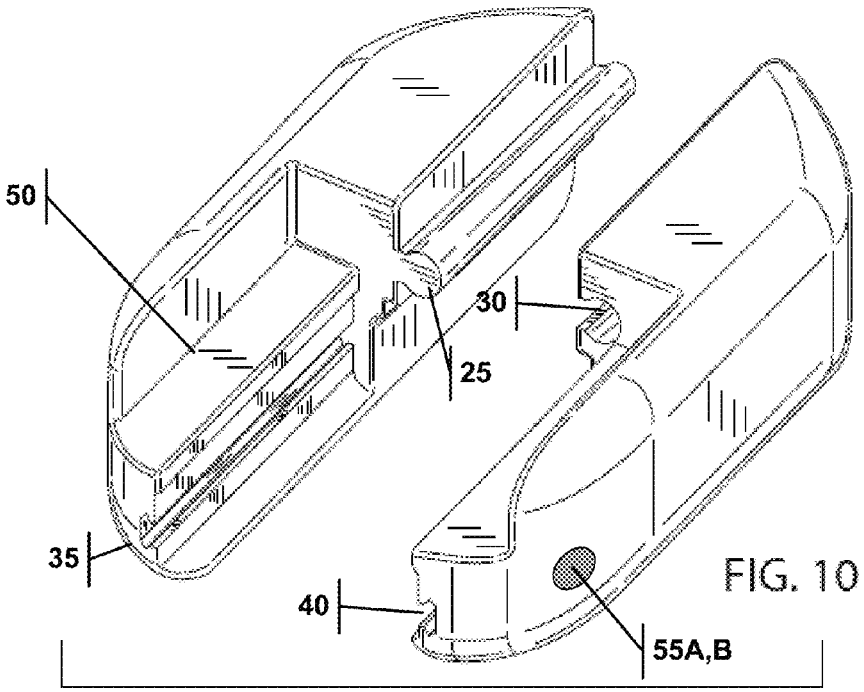
FIG. 10 is a bottom rear perspective exploded view of the first embodiment.
Figure 11:
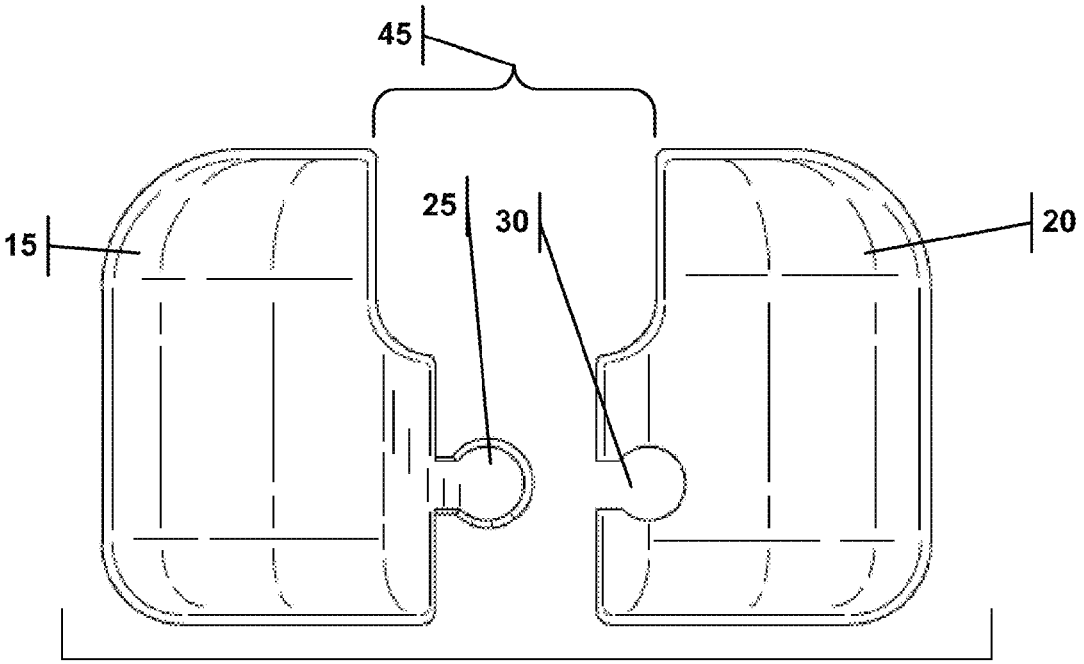
FIG. 11 is a front exploded view of the first embodiment.
Figure 12:
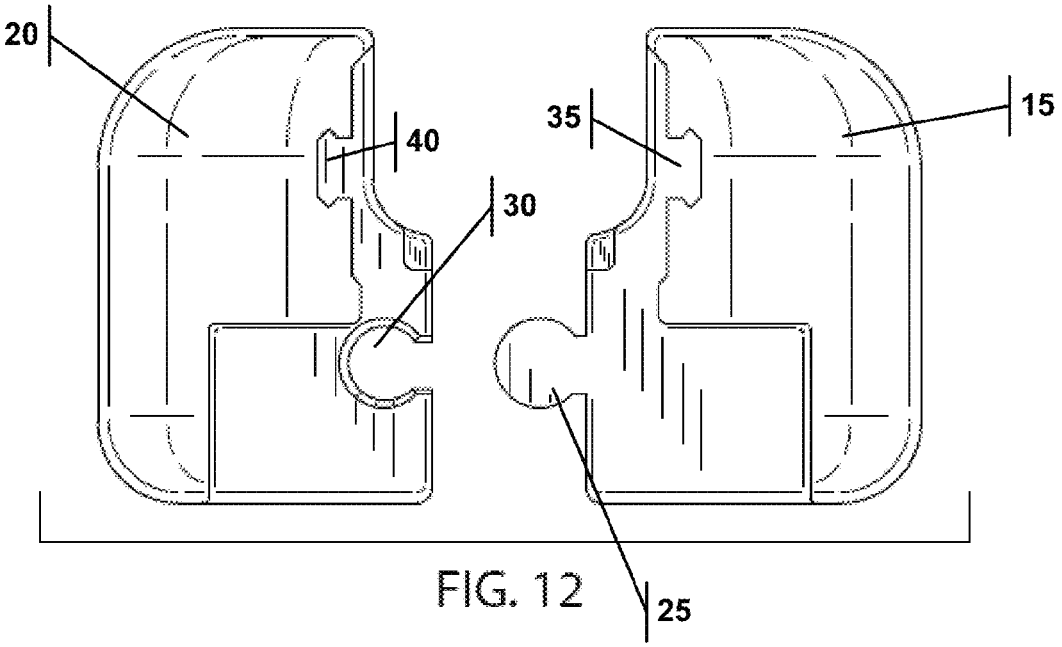
FIG. 12 is a rear exploded view of the first embodiment.
Figure 13:
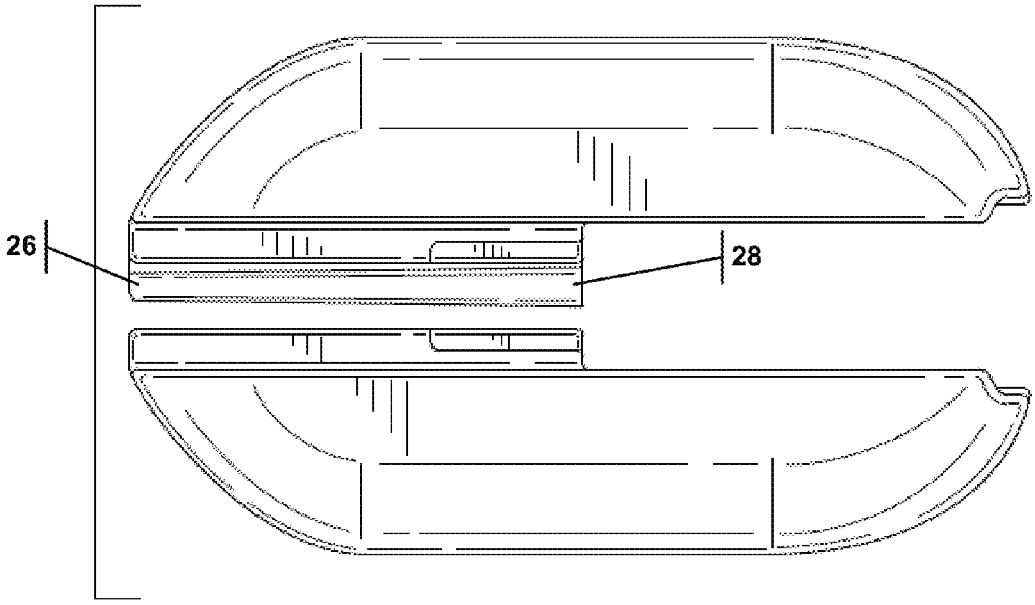
FIG. 13 is a top exploded view of the first embodiment.
Figure 14:
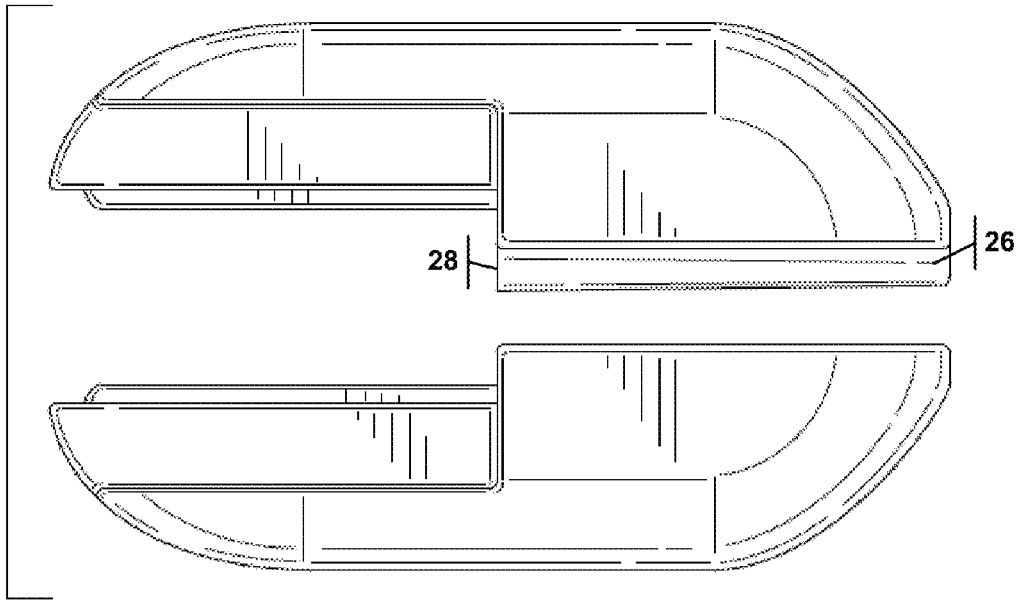
FIG. 14 is a rear exploded view of the first embodiment.
Figure 15:
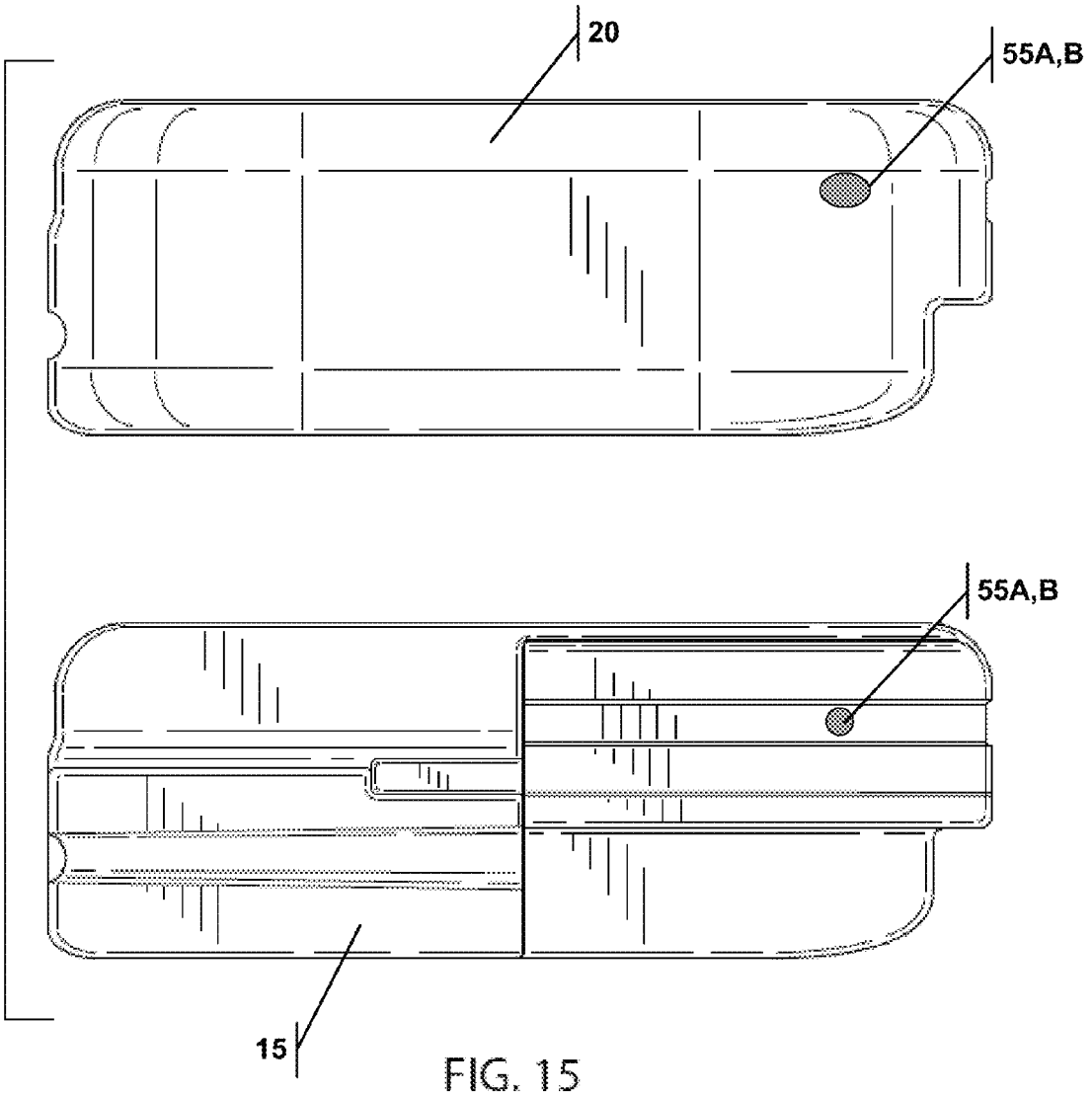
FIG. 15 is a right-side exploded view of the first embodiment.
Figure 16:
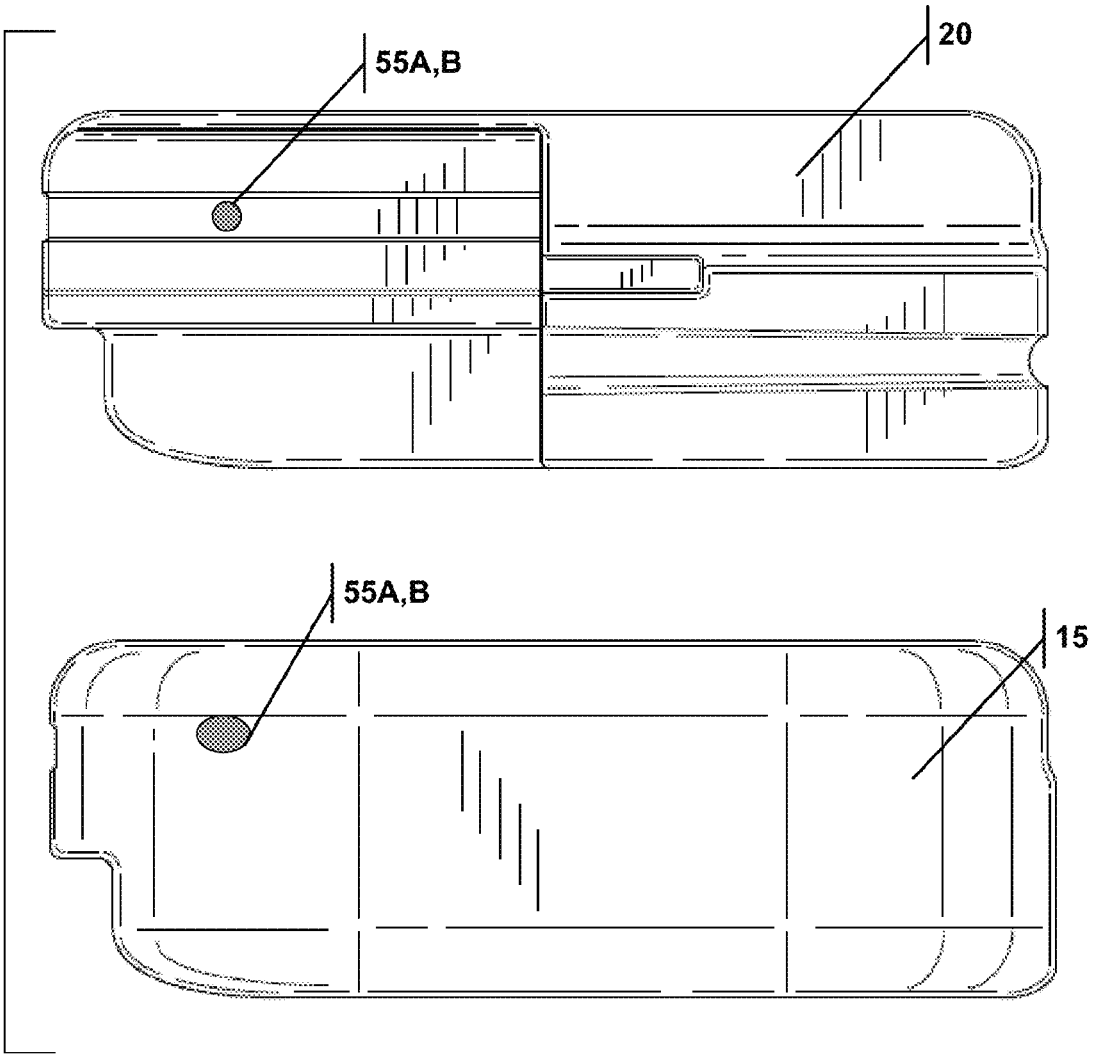
FIG. 16 is a left-side exploded view of the first embodiment.
Figure 17:
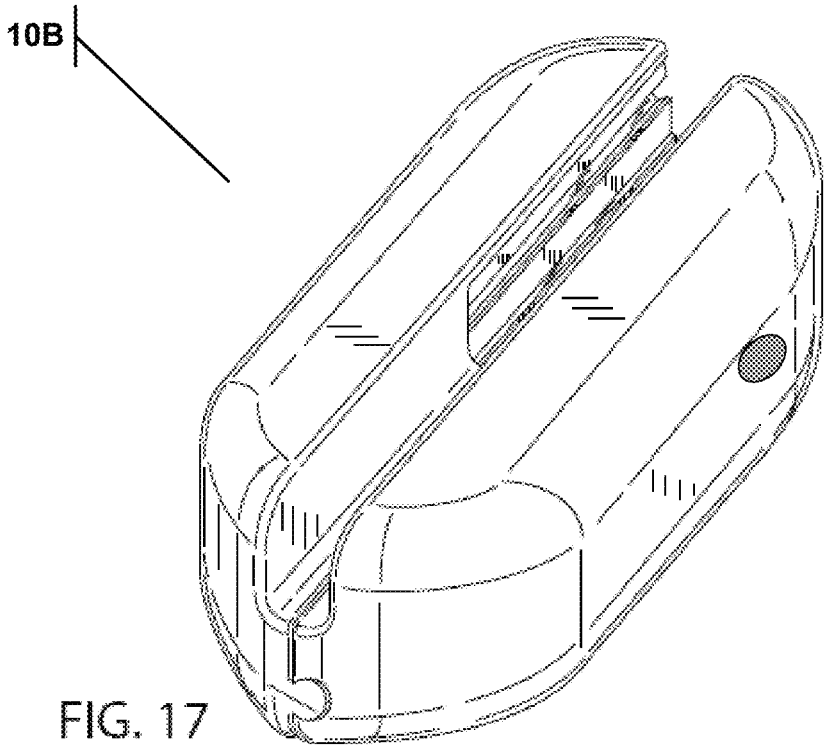
FIG. 17 is a top front perspective view of a second embodiment of a rifle flotation device.
Figure 18:
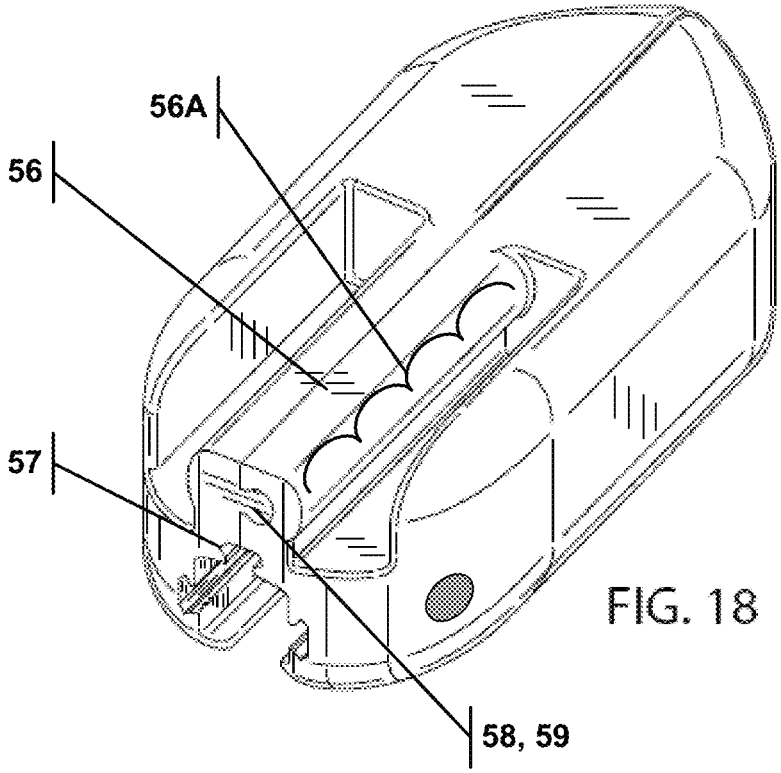
FIG. 18 is a bottom rear perspective view of the second embodiment.
Figure 19:
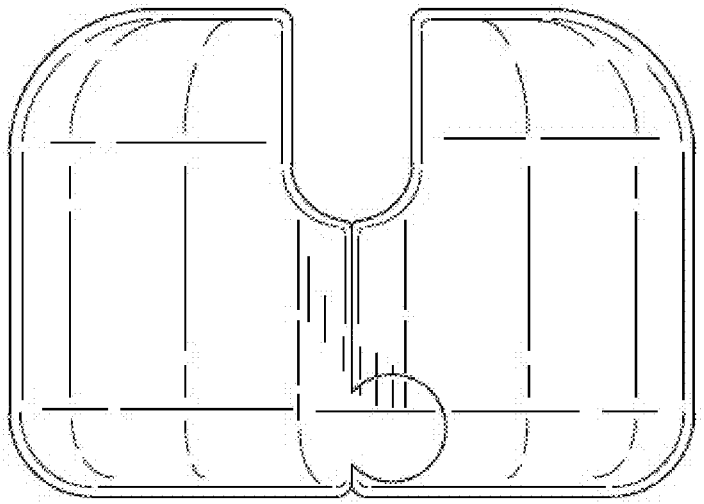
FIG. 19 is a front view of the second embodiment.
Figure 20:
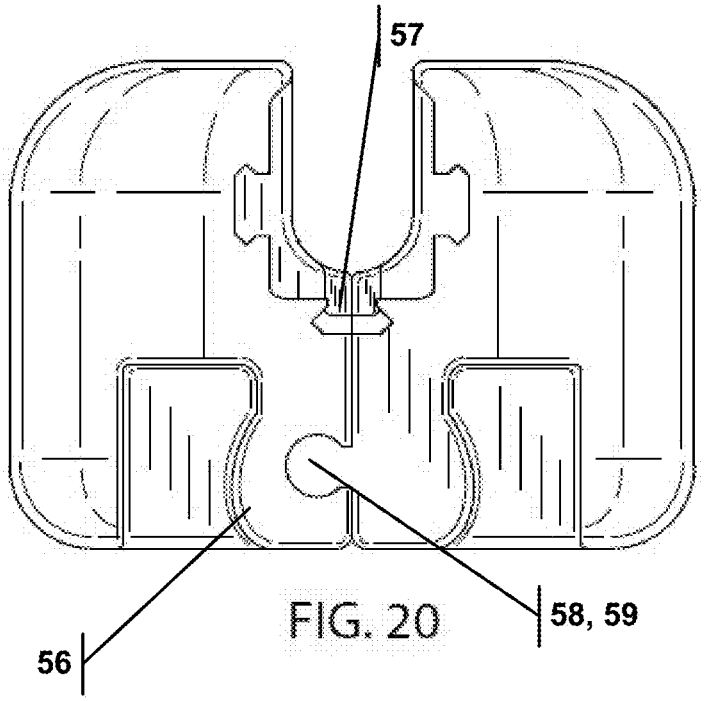
FIG. 20 is rear view of the second embodiment.
Figure 21:
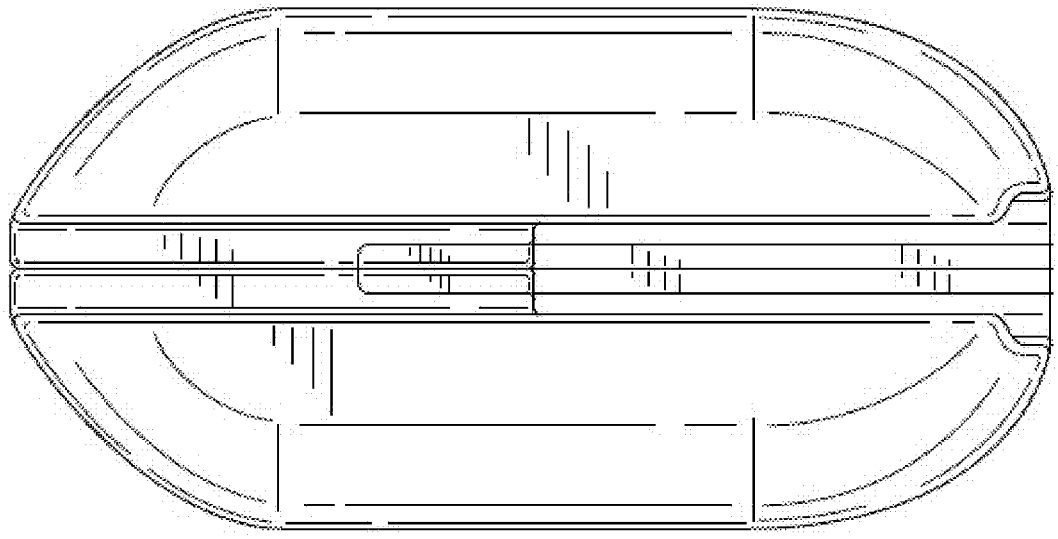
FIG. 21 is a top view of the second embodiment.
Figure 22:
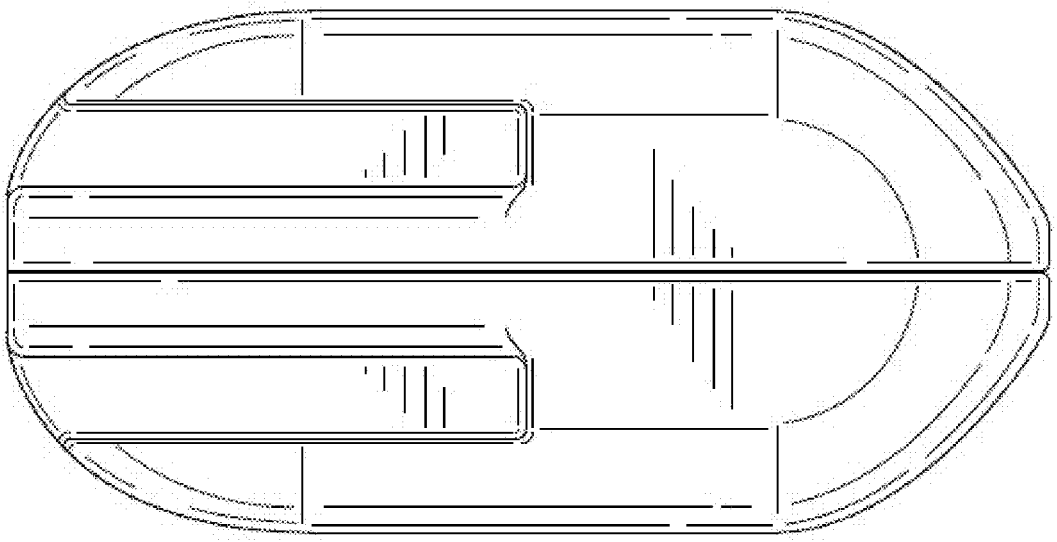
FIG. 22 is a bottom view of the second embodiment.
Figure 23:
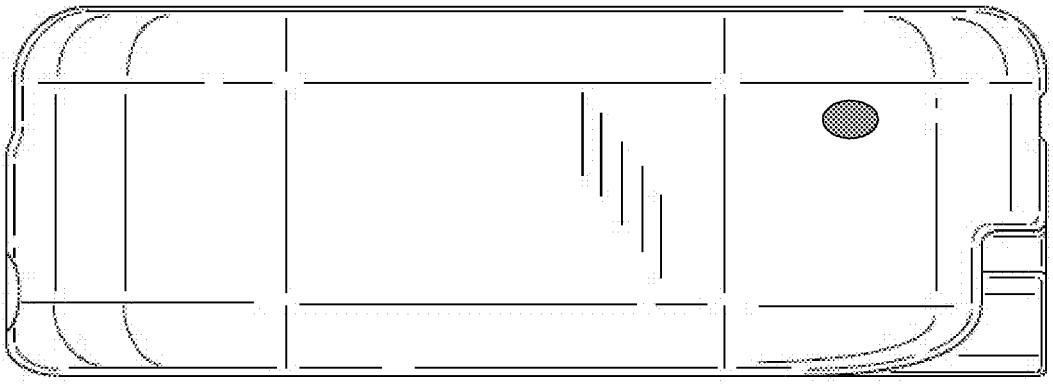
FIG. 23 is a right-side view of the second embodiment.
Figure 24:
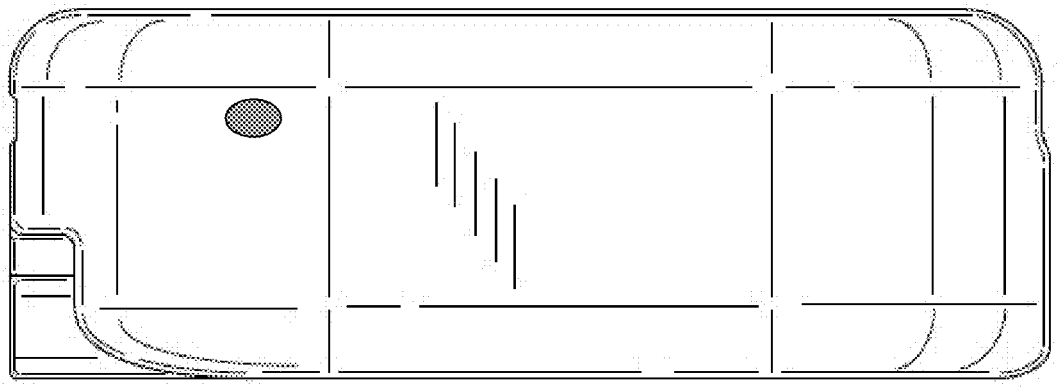
FIG. 24 is a left-side view of the second embodiment.
Figure 25:
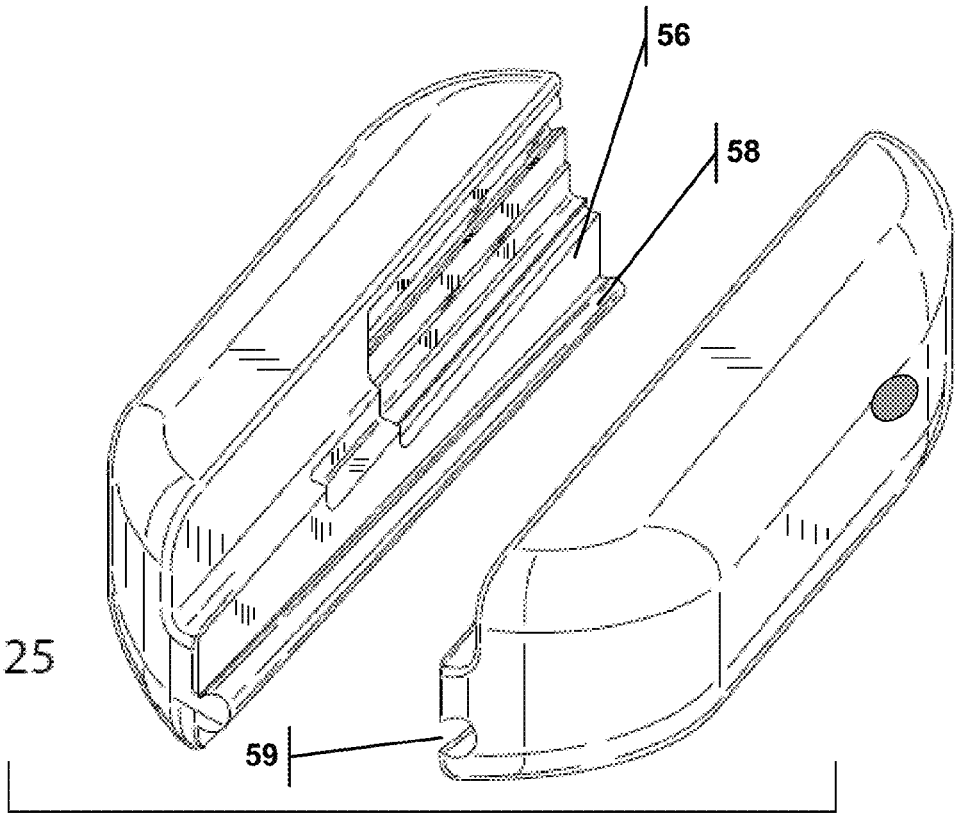
FIG. 25 is a top front perspective exploded view of the second embodiment.
Figure 26:
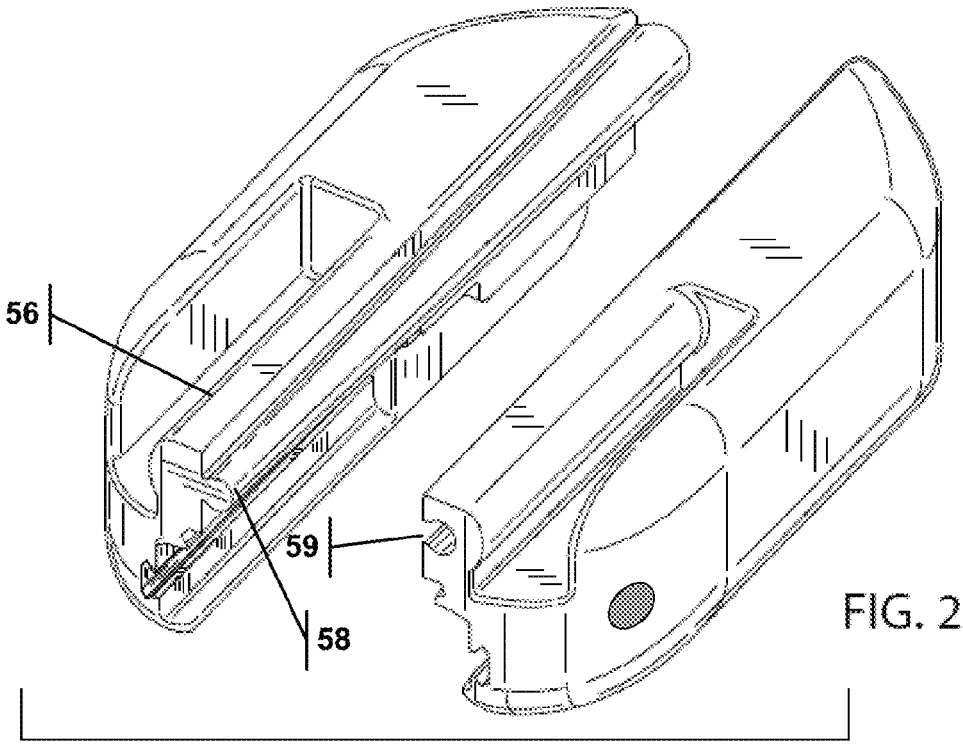
FIG. 26 is a bottom rear perspective exploded view of the second embodiment.
Figure 27:
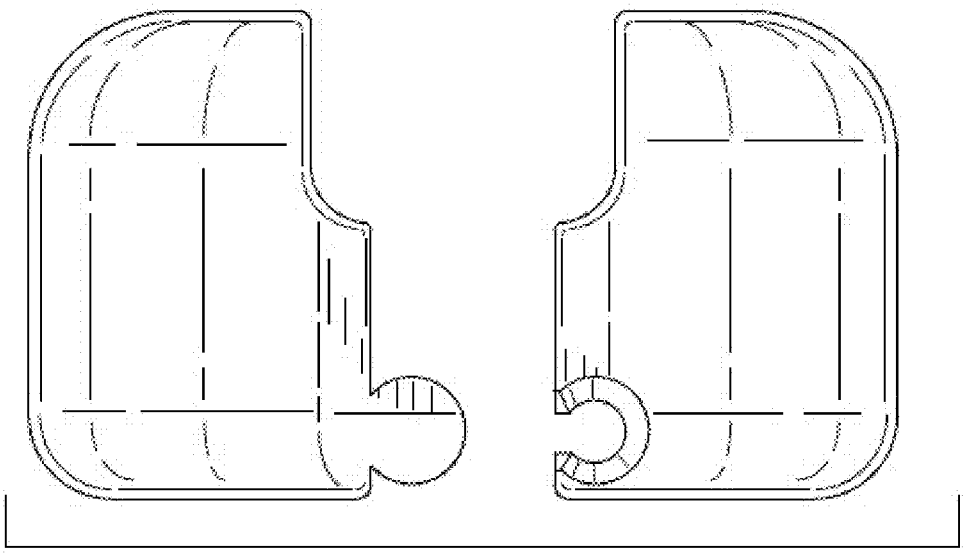
FIG. 27 is a front exploded view of the second embodiment.
Figure 28:
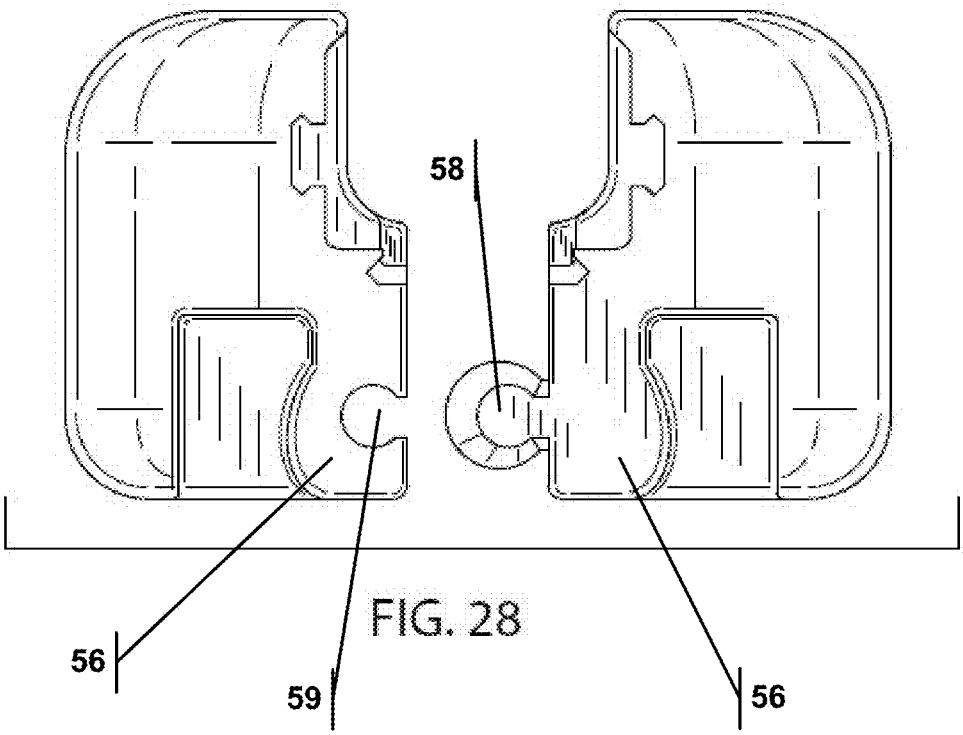
FIG. 28 is a rear exploded view of the second embodiment.
Figure 29:
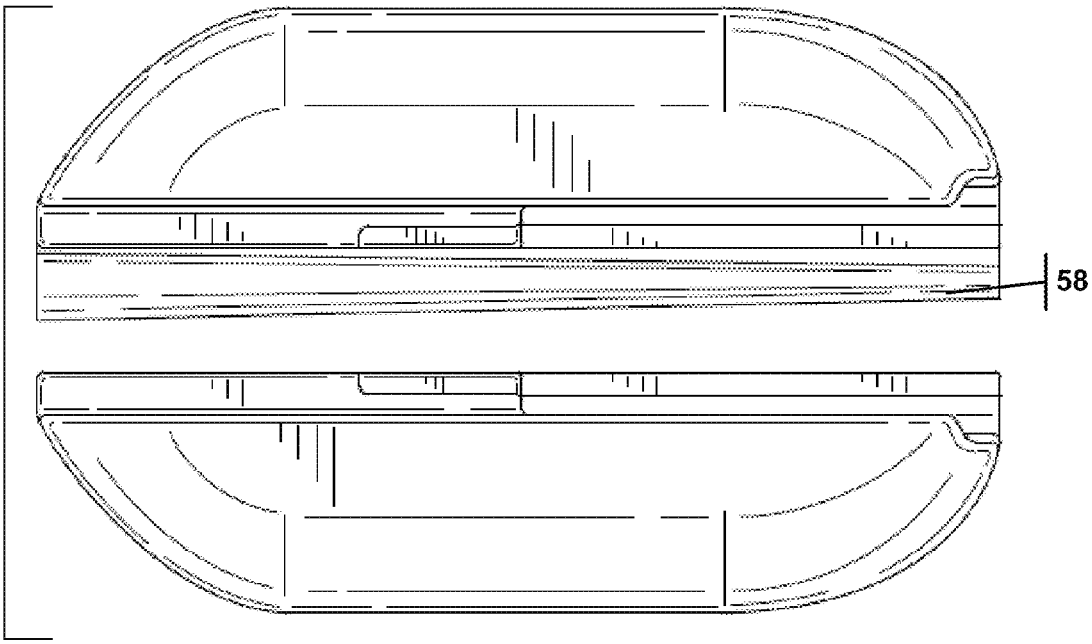
FIG. 29 is a top exploded view of the second embodiment.
Figure 30:
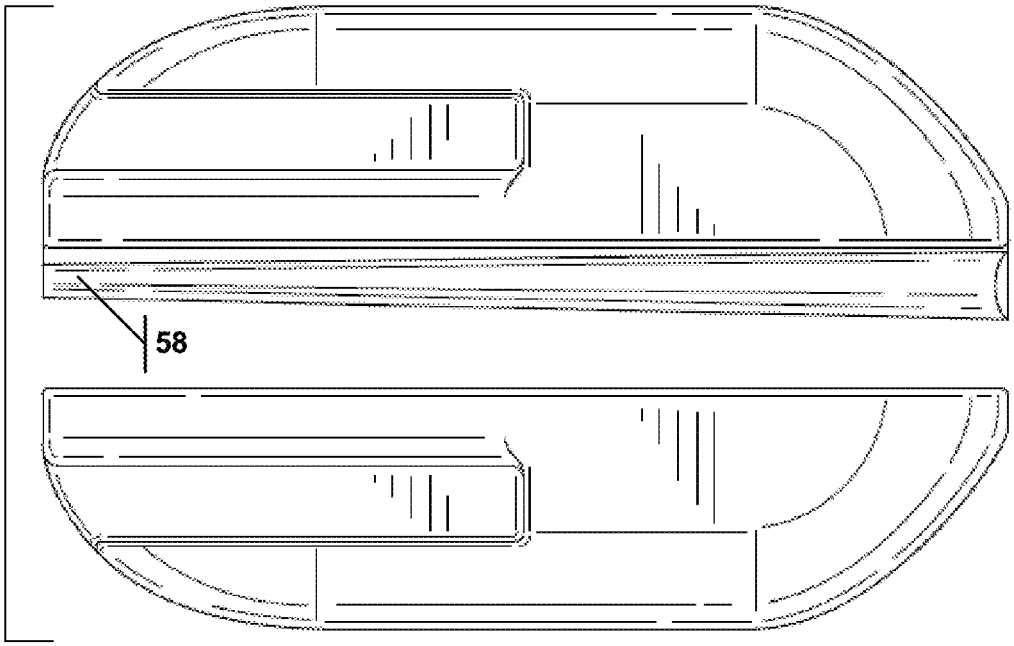
FIG. 30 is a rear exploded view of the second embodiment.
Figure 31:
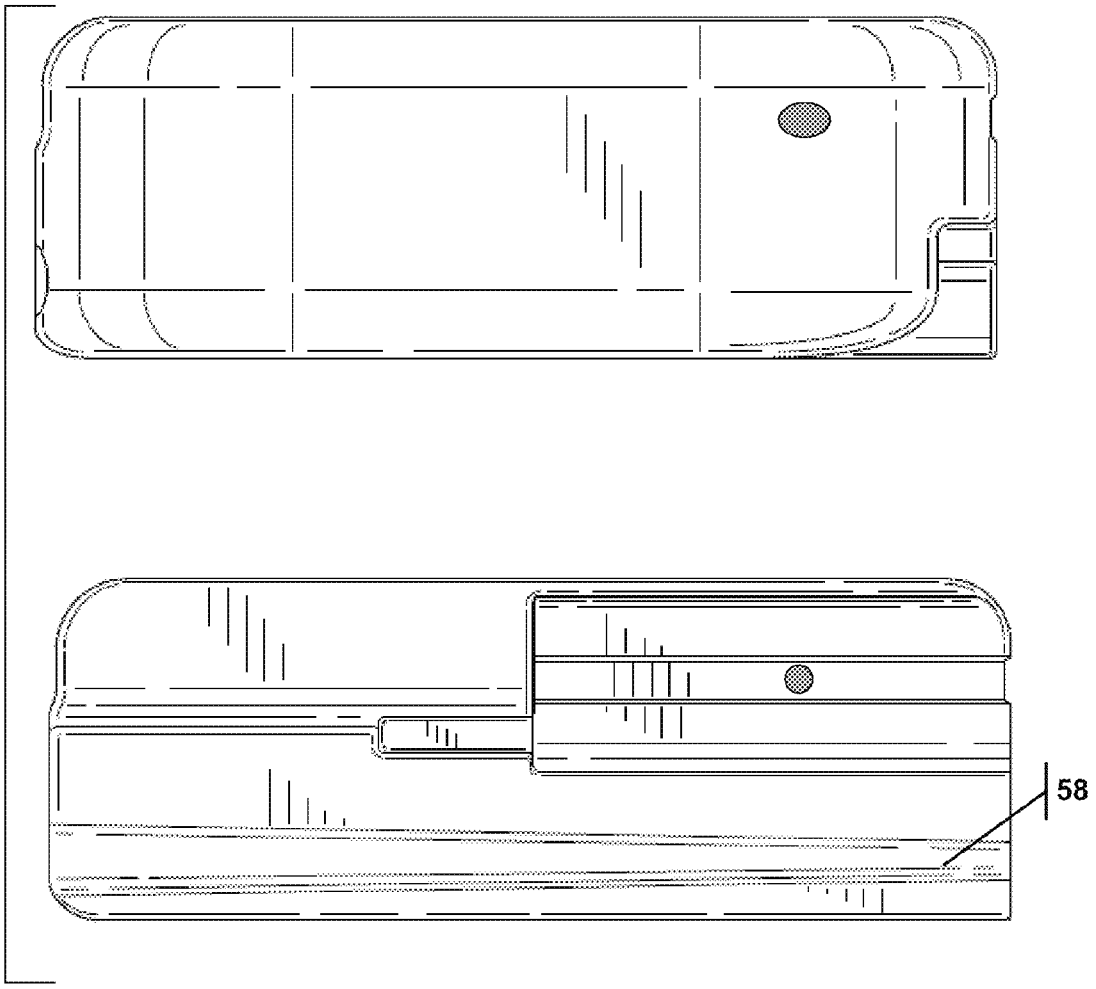
FIG. 31 is a right-side exploded view of the second embodiment.
Figure 32:
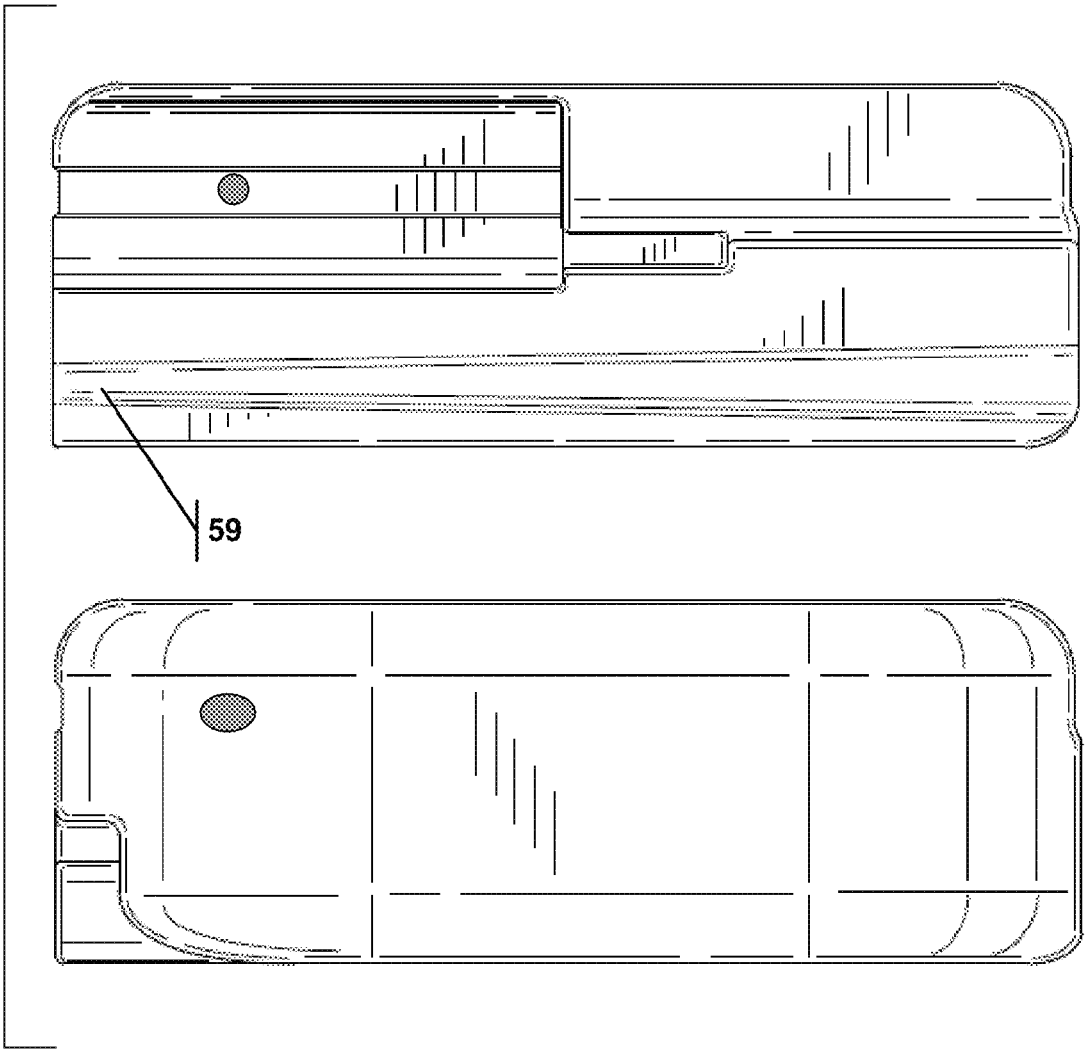
FIG. 32 is a left-side exploded view of the second embodiment.
Figure 33:
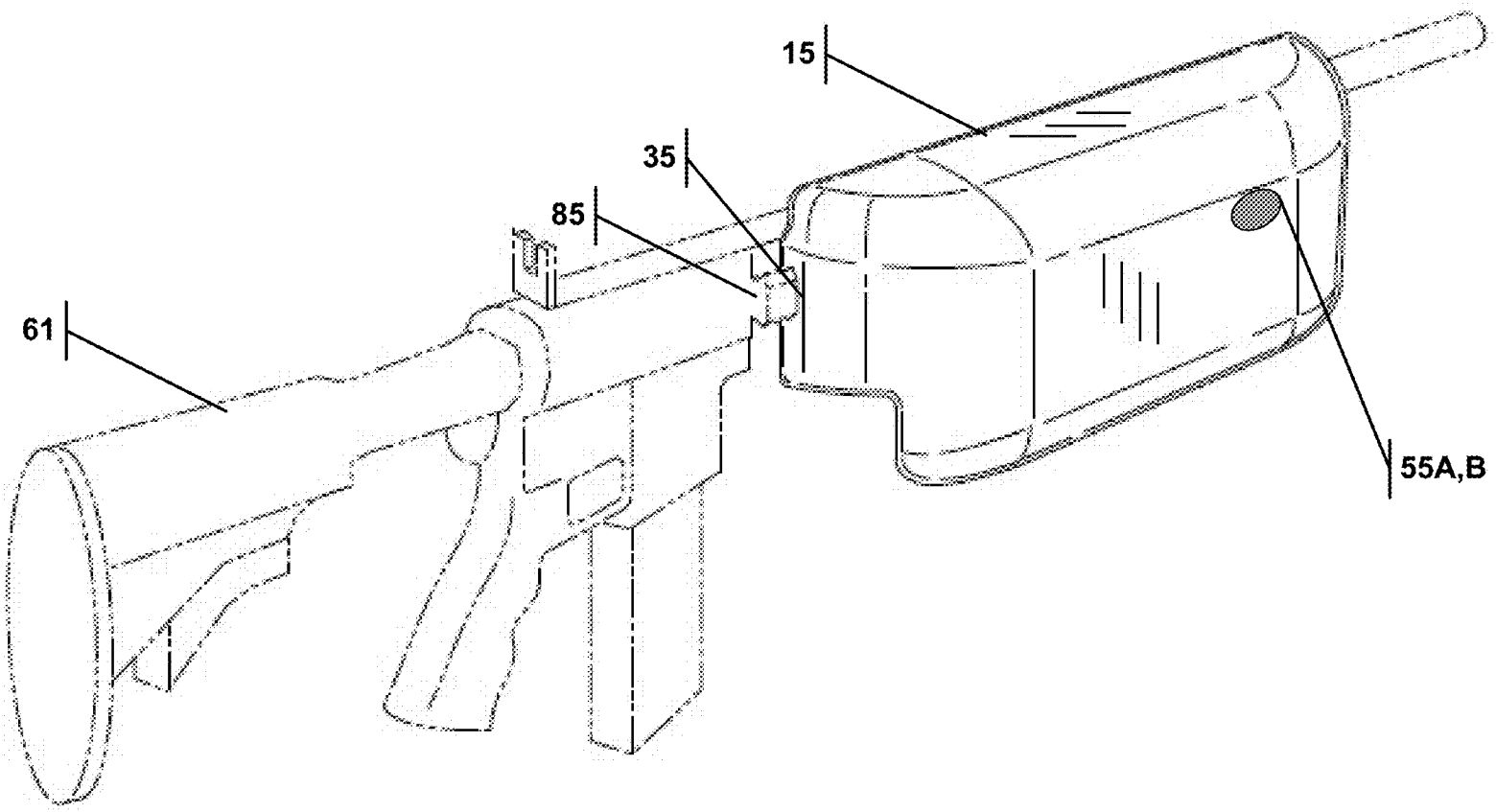
FIG. 33 is a top rear perspective view of a portion of the first embodiment of the rifle flotation device mounted to a rifle.

The rail slots 35 and 40 are keyed (shown in greater detail in FIGS. 4A and 4B), which means that they form a shape that complements and accommodates the insertion rifle rail system 85. As shown in FIG. 4B, once the rifle rail system is inserted into the keyed rifle rail slot 35, it cannot be removed in the direction of arrow 36, rather it must be slid off the rail system. This is also shown in FIG. 33.

The first buoyant body portion 15 may also have an interlocking tongue 25 that mates with an interlocking groove 30 found on the second buoyant body portion, connecting the two portions together. The interlocking tongue 25 and groove 30 may be tapered as shown in greater detail in FIGS. 13 and 14. The initial tongue depth 26 is smaller than the terminal tongue depth 28. This tapering allows the two buoyant body portions to connect together by sliding the tongue into the groove, but when the portions are in their final desired connected position relative to each other, the taper prevents the interlocking tongue 25 (and as a consequence the first buoyant body portion 15 attached to it) from sliding any further. When the interlocking tongue-in-groove is used, the device 10 may not use the first or second keyed rifle rail slots; rather, when the two buoyant body portions are mated together, they can fit snugly against the rifle such that an attachment to the rail system would be unnecessary. To further assist with keeping the device 10 snuggly fitted to the rifle, a fastener 32 may be used that brings the first and second buoyant body portions together. Non-limiting examples of the fastener 32 include a strap, Velcro®, and an elastic band. Also, to better grip the rifle, the device 10 may have a gripping non-slip material 33 that grips the rifle so as to prevent slippage. This alternative would be useful when attaching to a rifle that does not have a rifle rail system.

Figure 34:
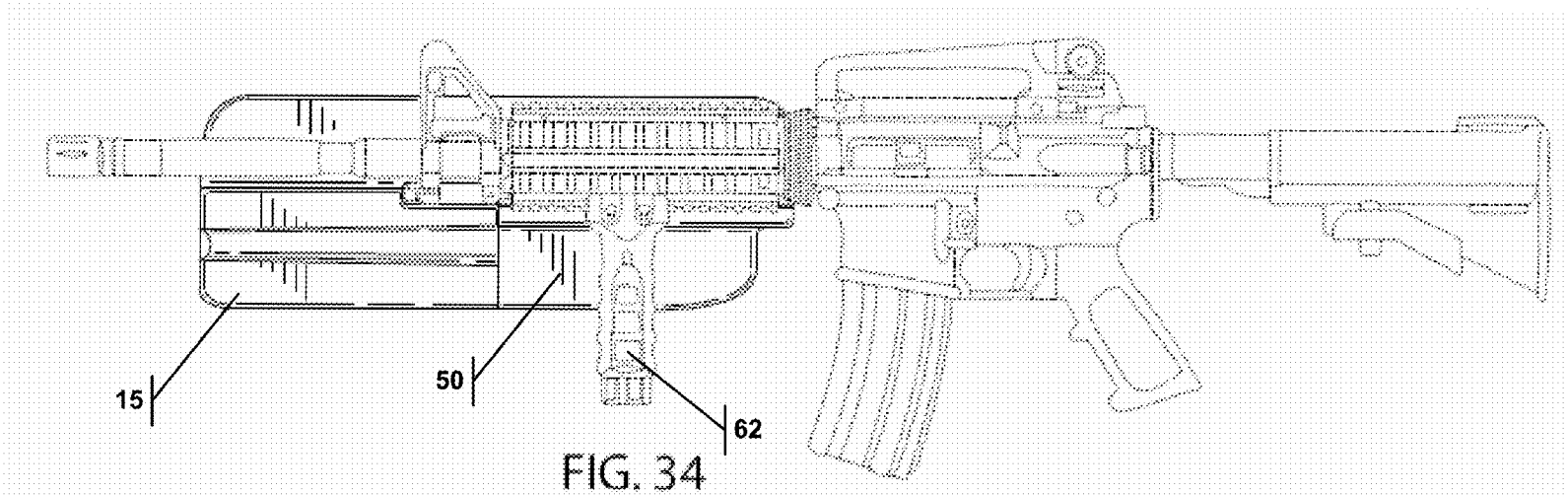
FIG. 34 is a right-side view of a portion of the first embodiment of the rifle flotation device mounted to a rifle.
Figure 36:
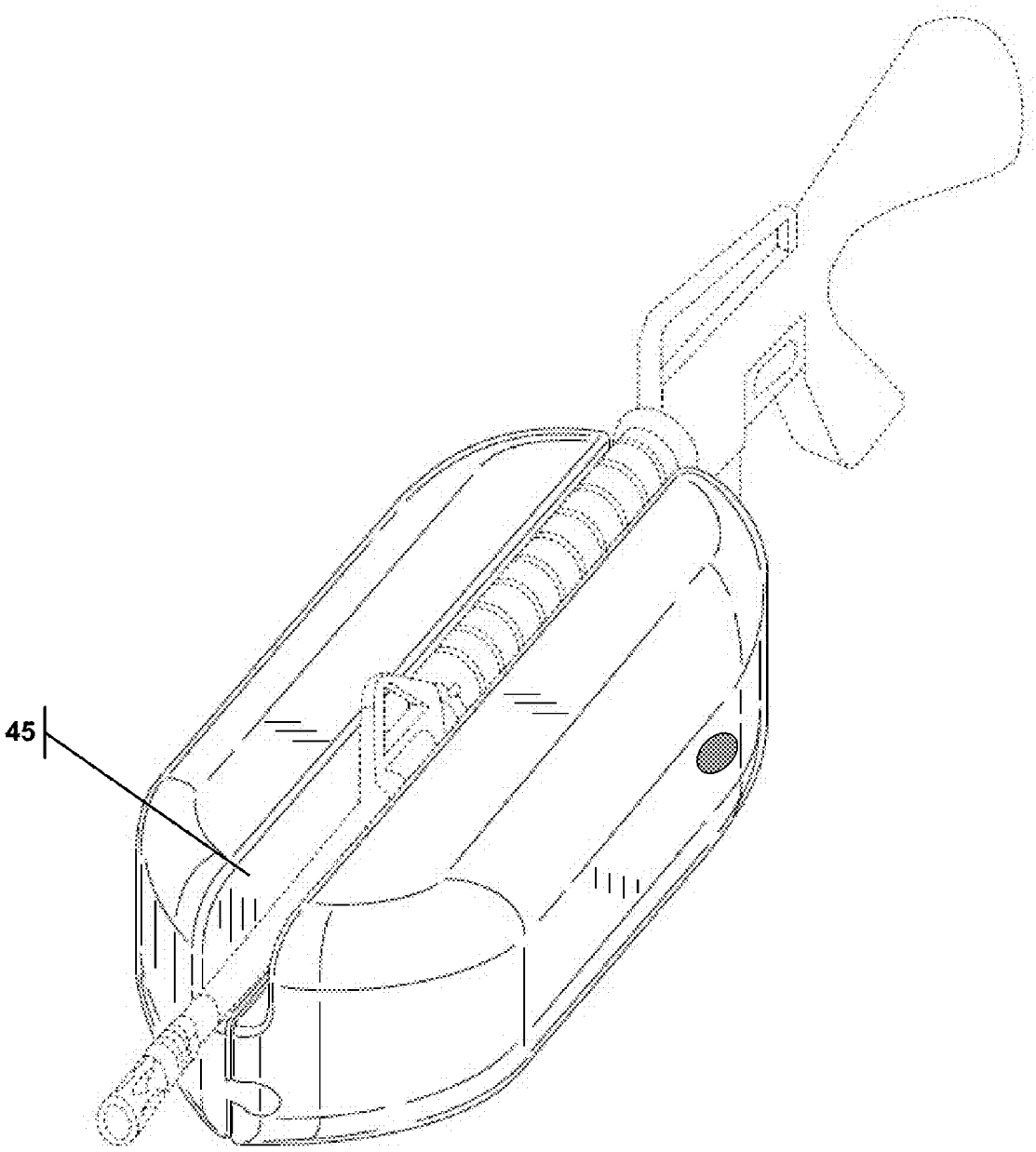
FIG. 36 is a top front perspective view of both portions of the first embodiment of the rifle flotation device mounted to a rifle.

The interlocking tongue 25 and interlocking groove 30 may run substantially parallel to the axis define by the barrel of the rifle when the device is mounted to the rifle. This orientation of the tongue and grooves allows a user to easily mount the float to the rifle, one buoyant body portion at a time. For example, FIG. 34 illustrates the first buoyant body portion 15 mounted to the rifle via the first keyed rifle rail slot, shown in detail under FIG. 33. And as described in more detail below, the first buoyant body portion 15 may have a mechanism that locks the portion to the rifle. After mounting the first buoyant body portion 15 the user can slide the second buoyant body portion 20 by inserting the tongue into the groove and sliding the second buoyant body portion in the direction from rifle muzzle tip to the trigger. The fully mounted device 10A with both buoyant body portions is shown in FIG. 36.

When the two buoyant body portions are joined, they may form a rifle barrel slot 45 that allows the rifle barrel to pass through the device without obstruction, and further allows the user to continue use of the rifle site as shown in FIG. 45. The first embodiment 10A also forms a rifle grip slot 50 when the two portions are joined. The rifle grip slot 50 accommodates a front rifle hand grip 62 that is used on some models of rifles, as shown in FIG. 34.

Figure 35:
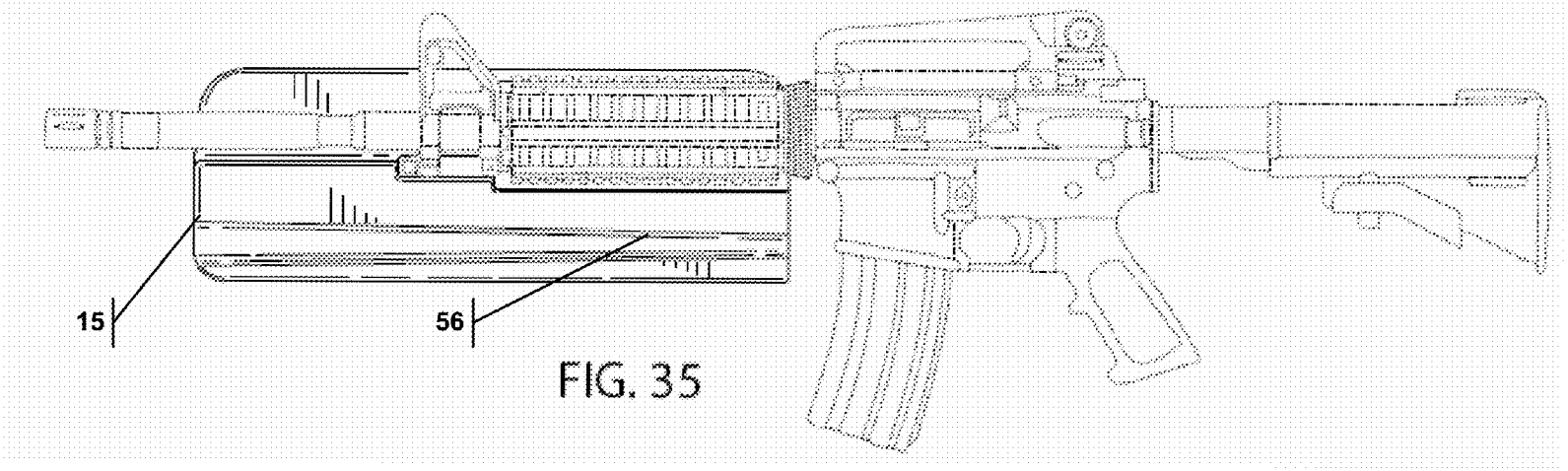
FIG. 35 is a right-side view of a portion of the second embodiment of the rifle flotation device mounted to a rifle.

FIGS. 17-32 illustrate a second embodiment of the rifle flotation device 10B. The device 10B is presented with the same views as that of the first embodiment 10B and is similar in many respects to the first embodiment 10A, except that the second embodiment 10B has a hand grip 56 that may have finger divots 56A to help the user better grip the device 10B when it is mounted to a rifle. The tapered portion-to-portion interlocking tongue 25 from the first embodiment 10A has been extended 58, and is formed into the hand grip 56. Likewise, the tapered portion-to-portion interlocking groove 30 has been extended 59. The second embodiment 10B can be used with a rifle that does not have a front rifle handgrip, as shown in FIG. 35. Moreover, the union of the first and second buoyant body portions forms a third keyed rifle rail slot 57, which also allows the rifle rail system to be inserted therein. This adds more stability to the device 10B as it is mounted to the rifle.

Figure 41:
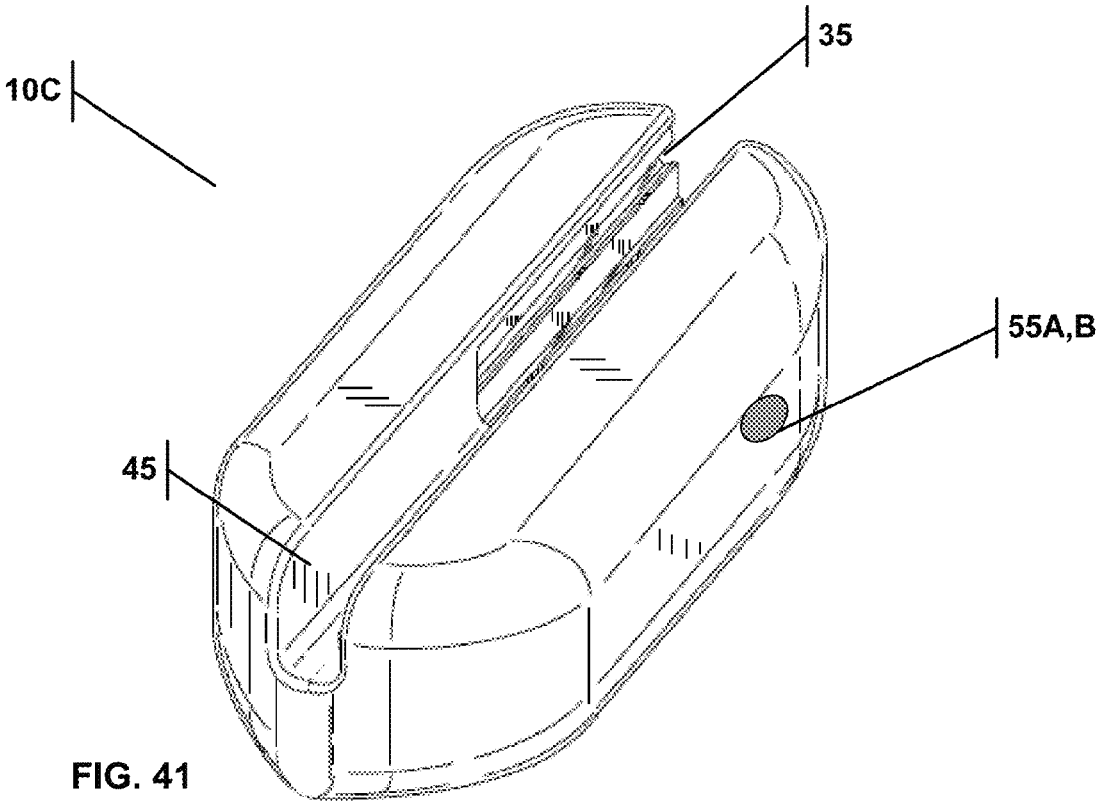
FIG. 41 is a top front perspective view of a third embodiment of a rifle flotation device.
Figure 42:
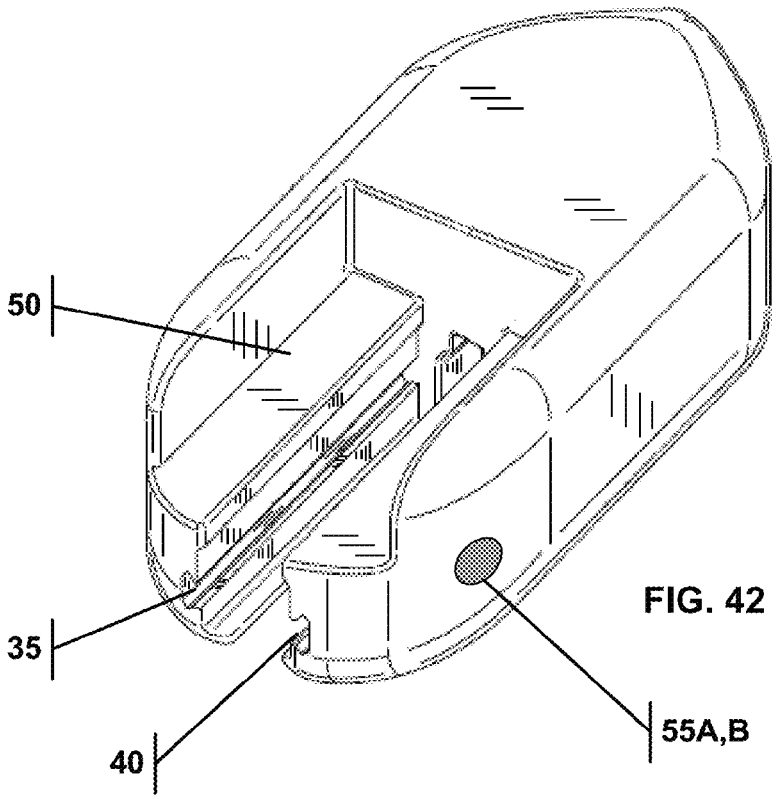
FIG. 42 is a bottom rear perspective view of the third embodiment.

FIGS. 41 and 42 illustrate a third embodiment 10C of the device where the device is a comprised of a single buoyant body that is mounted to the rifle by the first and second keyed rifle rail slots 35 and 40. This device 10C can also have a rifle barrel slot 45, a rifle hand grip slot 50 and a hand grip (not shown). Device 10C may also have a rifle rail lock and release mechanism 55A, 55B, and, given that it is a single buoyant body, only one such mechanism may be used to lock the entire device to the rifle.

Locking the flotation devices described above to the rifle adds greater stability and reliability. Thus, the devices may have a rifle rail lock and release mechanism 55A, 55B that locks and releases the device from the rifle. While the rifle rail lock and release mechanism 55A, 55B is shown in certain positions on the device, it would be apparent that the location of the mechanism can be changed.

Figure 37:
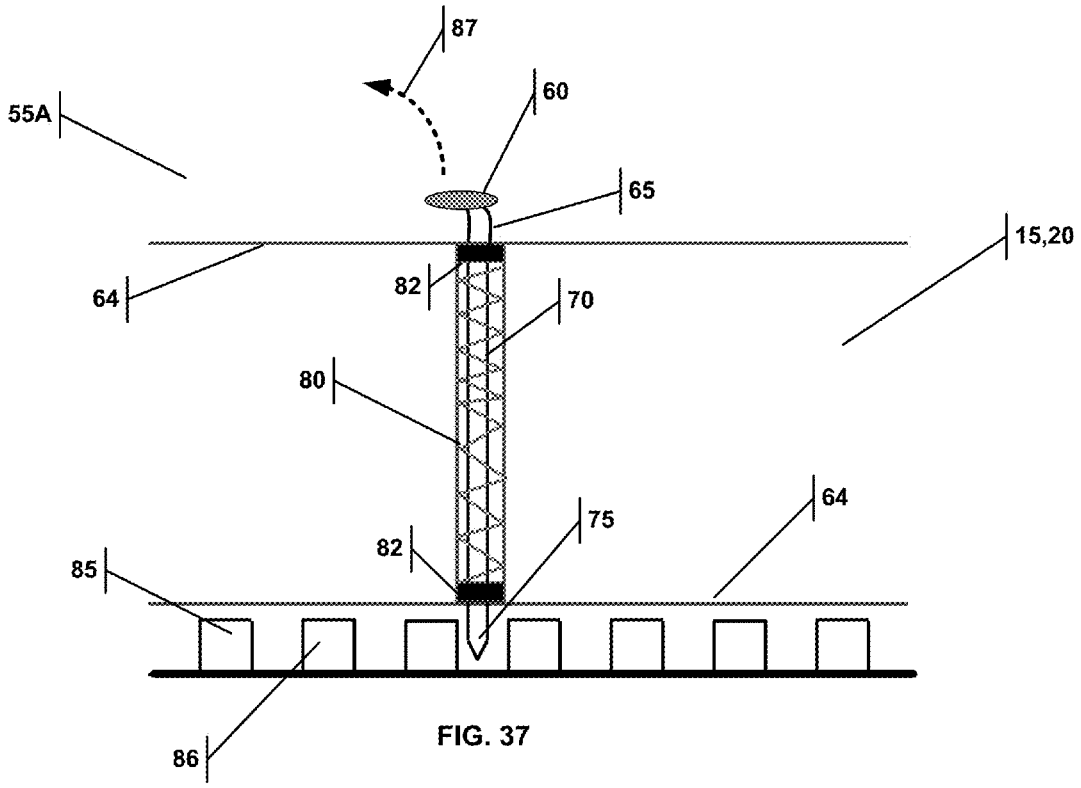
FIG. 37 illustrates a rifle rail lock and release mechanism.

Now with reference to FIGS. 37-40, a rifle rail lock and release mechanism 55A, 55B will be described. In FIG. 37, a mechanism 55A is disposed of inside of a buoyant body portion of the flotation device. It would be preferable to have such a mechanism in each buoyant body portion of the flotation device. The mechanism 55A is comprised of a rail engagement pin 75 with a spring 80 that biases it towards the rifle rail system 85, such that the rail engagement pin can catch on one of the rail bumps 86, thus preventing the portion from sliding off the rifle rail system 85. The rail engagement pin 75 can move between an engaged position and a disengaged position, wherein when the pin is in the engaged position (shown in FIG. 37), the buoyant body portion is locked to the rifle and when the pin is in the disengaged position (i.e., lifted away from the rifle rail system 85 such that the rail engagement pin 75 can clear the rail bumps 86) the buoyant body portion can be detached from the rifle. The movement of the rail engagement pin 75 shown in FIG. 37 is by way of a pull tab/button 60 that is connected to a connecting rod 70 by way of a flexible cable 65 that exits the buoyant body portion through the surface 64. Pulling the pull tab/button 60 in the direction of arrow 87 changes the position of the rail engagement pin from the engaged to the disengaged. Retraining structures 82 may be used to maintain the installation of mechanism 55A within the buoyant body portion.

Figure 38:
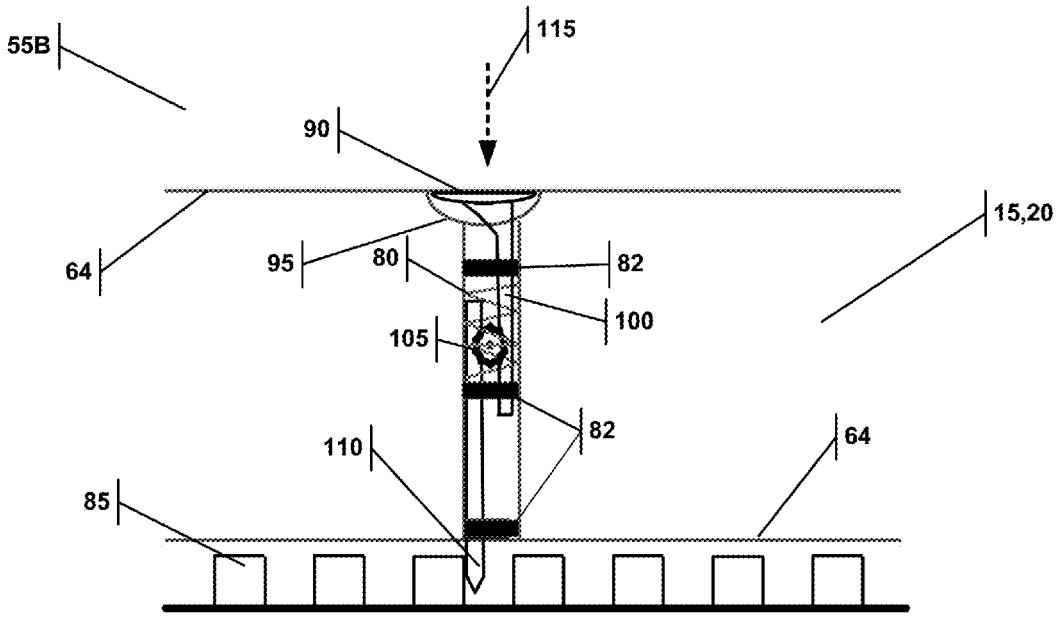
FIG. 38 illustrates a rifle rail lock and release mechanism.

FIG. 38 illustrates another mechanism 55B that changes the position of the rail engagement pin from the engaged to disengaged position via a push button. Specifically, a push button 90 may be connected to a connecting rod with gearing teeth 100. The rail engagement pin 110 may also have gearing teeth. Between the connecting rod 100 and the rail engagement pin 110 is a gear 105 that mates with the gearing teeth such that pushing the push button 90 in the direction of arrow 115 rotates the gear 105 and slides the rail engagement from the engaged to the disengaged position. A spring 80 may be used to bias the rail engagement pin 110 towards the rifle rail system 85, such that the rail engagement pin can catch on one of the rail bumps 86; thus preventing the portion from sliding off the rifle rail system 85. Alternatively, or in addition, the spring 80 may be a rotational spring that biases the gear 80 in a certain rotation, which in turn biases the rail engagement pin 110. The push button 90 may be disposed of in a recess 95 in the surface of the buoyant body portion, which may prevent the push button 90 from snagging on something, or being inadvertently pressed. Again, retraining structures 82 may be used to maintain the installation of mechanism 55B within the buoyant body portion.

Figure 39:
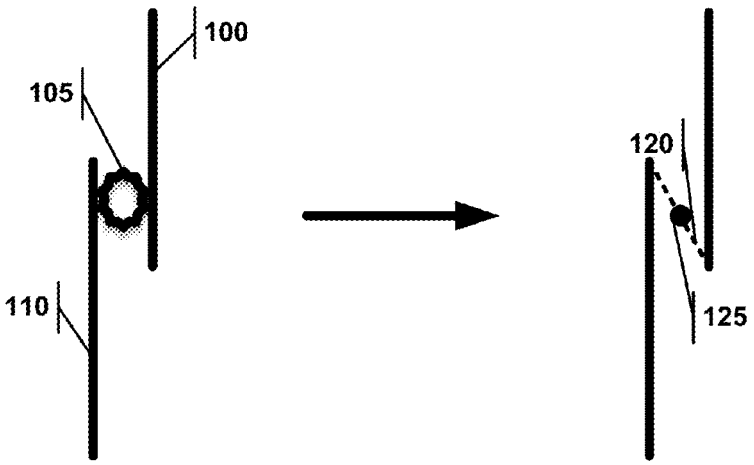
FIG. 39 illustrates a rifle rail lock and release mechanism.

FIG. 39 is a graphical illustration of another embodiment of the mechanism that operates similarly to that shown in FIG. 38; however, instead of a gear 105 between the connecting rod 100 and rail engagement pin 110, a pivot arm 120 connects to the connecting rod and the rail engagement pin. Pushing down on the rod causes the pivot arm 120 to pivot about pivot 125, translating the movement to the rail engagement pin.

Figure 40:
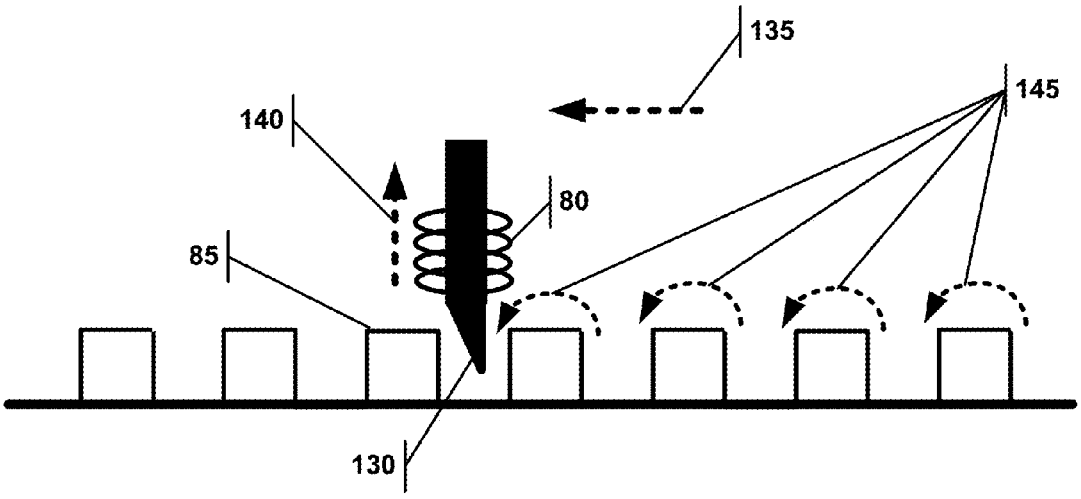
FIG. 40 illustrates the movement of the rail engagement pin with a unique tip shape.

FIG. 40 illustrates a unique rail engagement pin tip 130 that may be used with the embodiments of the mechanism just discussed. The pin tip 130 is shaped to allow the tip 130 to contact the rail bump 85 and slide over the bump 85 (arrow 140) when the mechanism slides in the direction of arrow 135. This would be helpful when the buoyant body portions 15 and 20 are slid onto the rifle rail system. The user could simply slide the buoyant body portions and the mechanisms therein in the direction of arrow 135 and the rail engagement pin would jump each bump as shown by arrows 145 until it reaches its final attached position on the rifle. Because of the tip's 130 shape, the user would not need to actively disengage the rail engagement pin, but rather it would "zip" over the rail bumps 85. However, movement of the buoyant body portions and the mechanisms therein in a direction opposite to arrow 135 would cause the rail engagement pin tip 130 to catch on the rail bump 85, preventing any further movement. To remove the buoyant body portions from the rifle, the user would have to actively disengage the rail engagement pin.

The devices described herein can be manufactured out of closed cell foam or material such as Spongex(r) thermoplastic elastomer foam, polypropylene, FloTex(r) foam, Styrofoam(r), EVA foam, Volara foam, polystyrene, expanded polystyrene, urethane foam, epoxy foams, and PVC foam. The device can also be made out of lightweight wood like balsa. The device can alternatively be constructed from plastic with a hollow core, whereby the air inside of the device creates the buoyancy. While this is a possible construction, it is not optimal because a puncture of the outer plastic (e.g. by a bullet) would cause the device to take in water. The key point is that the construction type or material should yield a device that is buoyant in saltwater and freshwater when it is mounted to a rifle. Moreover, the rifle may be fully outfitted with attachments and large ammunition magazines, so the rifle weight can vary. For example, a standard bare and unloaded AR-15(M4) weighs about 6.36 lbs. With a standard 30 round magazine, the AR-15(M4) weighs about 7.5 lbs., while outfitting it with a laser/night vision scope, full rail system, custom stock and large ammunition magazine might cause the weight to jump to 9+ lbs. The device should therefore be sufficiently buoyant to accommodate the variation in potential weight.

Although exemplary embodiments and applications of the invention have been described herein including as described above and shown in the included example Figures, it is not intended that the invention be limited to these exemplary embodiments and applications or to the manner in which the exemplary embodiments and applications operate or are described herein. Indeed, many variations and modifications to the exemplary embodiments are possible, as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A rifle flotation device for a rifle with a rifle rail system, the device comprising:

a buoyant body comprising a first keyed rifle rail slot and a second keyed rifle rail slot wherein the first and second keyed rifle rail slots are constructed to allow the rifle rail system to be inserted therein;

wherein the buoyant body is sufficiently buoyant to render the rifle buoyant in water when the rifle is attached to the buoyant body.

2. The device of claim 1, wherein the buoyant body comprises:

a first buoyant body portion further comprising the first keyed rifle rail slot; and a second buoyant body portion further comprising the second keyed rifle rail slot; and wherein the first buoyant body portion is detachable from the second buoyant body portion.

3. The device of claim 2, comprising a third keyed rifle rail slot constructed to allow the rifle rail system to be inserted therein, the third slot is formed at the union of the first and second buoyant body portions.

4. The device of claim 2, wherein the first buoyant body portion comprises an interlocking tongue and the second buoyant body comprises an interlocking groove, wherein the tongue fits into the groove and connects the first buoyant body portion to the second buoyant body portion.

5. The device of claim 4, comprising a hand grip and the tongue and groove are part of the hand grip.

6. The device of claim 4, wherein the tongue is tapered and the groove is tapered.

7. The device of claim 4, wherein the tongue comprises a longitudinal axis and the axis is substantially parallel to the axis defined by the barrel of the rifle when the device is mounted to the rifle.

8. The device of claim 2, comprising a rifle rail lock and release mechanism, the mechanism comprising:

a first and second rail engagement pins that can each move between an engaged position and a disengaged position, wherein:

the first pin is located in the first keyed rifle rail slot and when the first pin is in the engaged position, the first buoyant body portion is locked to the rifle and when the first pin is in the disengaged position, the first buoyant body portion can be detached from the rifle; and the second pin is located in the second keyed rifle rail slot and when the second pin is in the engaged position, the second buoyant body portion is locked to the rifle and when the second pin is in the disengaged position, the second buoyant body portion can be detached from the rifle.

9. The device of claim 8, wherein the rifle rail lock and release mechanism comprises springs that bias the first and second rail engagement pins in the engaged position.

10. The device of claim 8, wherein the rifle rail lock and release mechanism comprises a pull tab or pull button connected to at least one of the rail engagement pins such that pulling the pull tab or pull button changes the rail engagement pin from the engaged to the disengaged position.

11. The device of claim 8, wherein the rifle rail lock and release mechanism comprises a push button connected to at least one of the rail engagement pins such that pushing the button changes the rail engagement pin from the engaged to the disengaged position.

12. The device of claim 1, comprising a rifle barrel slot.

13. The device of claim 1, comprising a rifle hand grip slot.

14. The device of claim 1, comprising a hand grip.

15. The device of claim 1, comprising a rifle rail lock and release mechanism, the mechanism comprising a rail engagement pin that can move between an engaged position and a disengaged position, wherein when the pin is in the engaged position, the body is locked to the rifle and when the pin is in the disengaged position, the body can be detached from the rifle.

16. The device of claim 15, wherein the rifle rail lock and release mechanism comprises a spring that biases the rail engagement pin in the engaged position.

17. The device of claim 16, wherein the rifle rail system has a plurality of bumps and the rail engagement pin tip is shaped to allow the rail engagement pin to slide over the plurality of bumps when the mechanism moves in a first direction and the rail engagement pin catches on at least one of the plurality of bumps when the mechanism moves in an direction opposite to the first direction.

18. The device of claim 15, wherein the rifle rail lock and release mechanism comprises a pull tab or pull button connected to the rail engagement pin such that pulling the pull tab or pull button changes the rail engagement pin from the engaged to the disengaged position.

19. The device of claim 15, wherein the rifle rail lock and release mechanism comprises a push button connected to the rail engagement pin such that pushing the button changes the rail engagement pin from the engaged to the disengaged position.

* * * * *